US007976775B2

(12) United States Patent
Sasaki et al.

(10) Patent No.: US 7,976,775 B2
(45) Date of Patent: Jul. 12, 2011

(54) SINTERED BINARY ALUMINUM ALLOY POWDER SINTERED MATERIAL AND METHOD FOR PRODUCTION THEREOF

(75) Inventors: Taisuke Sasaki, Ibaraki (JP); Kazuhiro Hono, Ibaraki (JP); Toshiji Mukai, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 0 days.

(21) Appl. No.: 12/450,432

(22) PCT Filed: Mar. 25, 2008

(86) PCT No.: PCT/JP2008/055602

§ 371 (c)(1),
(2), (4) Date: Jul. 12, 2010

(87) PCT Pub. No.: WO2008/123258

PCT Pub. Date: Oct. 16, 2008

(65) Prior Publication Data

US 2010/0278682 A1 Nov. 4, 2010

(30) Foreign Application Priority Data

Mar. 26, 2007 (JP) ..... 2007-078283

(51) Int. Cl.
*C22C 21/00* (2006.01)

(52) U.S. Cl. ..... 419/32; 75/228; 75/255; 75/343; 75/392

(58) Field of Classification Search ..... 419/33; 75/228, 255, 343, 392
See application file for complete search history.

(56) References Cited

FOREIGN PATENT DOCUMENTS

| | | |
|---|---|---|
| JP | 4-26742 | 1/1992 |
| JP | 05331586 A | * 12/1993 |
| JP | 6-145921 | 5/1994 |
| JP | 7-258702 | 10/1995 |
| JP | 8-283921 | 10/1996 |

OTHER PUBLICATIONS

English Computer Translation of JP05331586A.*
International Search Report issued Jun. 24, 2008 in International (PCT) Application No. PCT/JP2008/055602.

* cited by examiner

*Primary Examiner* — Jessica L Ward
*Assistant Examiner* — Erin B Saad
(74) *Attorney, Agent, or Firm* — Wenderoth, Lind & Ponack L.L.P.

(57) ABSTRACT

Disclosed is a binary aluminum alloy powder sintered material which comprises aluminum and iron, which has a completely crystalline microstructure comprising an aluminum matrix and an α-Al phase and at least any one phase of an $Al_6Fe$ phase or an $Al_{13}Fe_4$ phase mixed in the aluminum matrix as nanocrystalline phases, and which has an extremely high strength and a well-balanced high ductility, though being free from any rare earth element.

4 Claims, 29 Drawing Sheets

SINTERED BINARY ALUMINUM ALLOY POWDER SINTERED MATERIAL AND METHOD FOR PRODUCTION THEREOF

TECHNICAL FIELD

The present invention relates to a binary aluminum alloy comprising aluminum and mainly iron alone incorporated therein. More precisely, the invention relates to a binary aluminum alloy powder sintered material having excellent high strength well balanced with high ductility though being free from any rare earth element, and to a method for producing it.

BACKGROUND ART

Various types of the above-mentioned binary aluminum alloy are known.

However, the strength to be attained according to the process of dissolution, heat treatment or working heat treatment described in Patent References 12 and 13 is limited.

As confirmed from the descriptions in Patent References 1 to 13, no one could obtain a bulky high-strength alloy comprising only two constitutive elements and having a strength on a level of 1 GPa or so.

For enhancing the strength, Patent References 1 to 5 and 8 to 11 describe incorporation of a rare earth element, but use of an element much rarer than iron is defective in that it detracts from versatility.

The aluminum alloy described in Patent References 1 and 2 has a relatively high strength but has a form of rapid-quenched thin ribbon, and at present, therefore, its practicability is low, and for its practical use, it must be bulky.

Patent References 3 and 4 describe a technique of making the rapid-quenched thin ribbon bulky, but the process is extremely complicated and is impracticable.

The oxidation treatment of the powder in the process of producing an alloy powder described in Patent References 6 and 7 has a risk of greatly detracting from the ductility of the alloy.

Further, regarding the addition of a dispersant described in Patent Reference 7, it may greatly detract from the mechanical properties, especially the ductility of the alloy when the amount thereof added is excessive. Regarding the technology of preliminary shaping and SPS described in Patent Reference 12, the alloy is shaped into a shaped article in the subsequent superplastic forging step though it is processable in near-net-shaping, and therefore this could not fully utilize the advantage of SPS. In the electron beam vapor deposition method described in Patent References 11 and 13, the thickness of the alloy formed is difficult to increase.

The alloy described in Patent References 1 to 5 and 9 has an amorphous or semi-crystalline, non-equivalent structure, and therefore its structure stability at high temperatures is poor.

Patent Reference 1: JP-A 5-331584
Patent Reference 2: JP-A 5-331586
Patent Reference 3: JP-A 1-275732
Patent Reference 4: JP-A 6-41702
Patent Reference 5: JP-A 6-184712
Patent Reference 6: JP-A 7-268401
Patent Reference 7: JP-A 9-31567
Patent Reference 8: JP-A 8-232032
Patent Reference 9: JP-A 9-111313
Patent Reference 10: JP-A 6-17180
Patent Reference 11: JP-A 8-283921

Patent Reference 12: JP-A 11-209839
Patent Reference 13: JP-A 2003-277866

DISCLOSURE OF THE INVENTION

Problems that the Invention is to Solve

Taking the situation as above into consideration, an object of the invention is to provide a high-strength aluminum alloy powder sintered material having a completely crystalline microstructure formed therein though being free from any rare earth element, and having solved the above-mentioned problems, and to provide a method for producing it.

Means for Solving the Problems

The binary aluminum alloy powder sintered material of the invention is first characterized in that it consists of aluminum and iron and that an α-Al phase and at least any one phase of an $A_6Fe$ phase or an $Al_{13}Fe_4$ phase exist in the aluminum matrix as nanocrystalline phases as mixed.

The binary aluminum alloy powder sintered material of the invention is secondly characterized in that, in the above-mentioned first aspect, the ratio by volume of the coarse grains of the mixedly-existing α-Al phase is less than 5%.

The method for producing the binary aluminum alloy powder sintered material of the invention is thirdly characterized in that aluminum and iron are mixed while ground in a nano-level size according to a mechanical alloying method in an inert gas to thereby forcedly dissolving iron in aluminum, and then the mixed powder is sintered in vacuum or in an inert gas thereby producing the binary aluminum alloy powder sintered material having the above-mentioned first or second characteristic aspect.

ADVANTAGE OF THE INVENTION

The binary aluminum alloy powder sintered material having the first characteristic aspect of the invention has an extremely high yield strength of 1 GPa or more, though being free from any rare earth element. It exhibits a ductility of at least 0.2 to compression strain, which indicates high practicability of the alloy powder surpassing the strength-ductility balance of any other crystalline aluminum alloy. These characteristics result from the existence of the second phase or the second phase as combined with the third phase, in which the individual phases are kept ground in a nano-scale size.

The binary aluminum alloy powder sintered material having the second characteristic aspect of the invention further has a strength of around 500 MPa at 350° C., which is much higher than the strength at high temperatures of conventional aluminum alloys. This is attained by reducing the ratio by volume of the coarse grains of the α-Al phase. The $Al_6Fe$ phase is a phase stable at up to 600° C. or so, and therefore the alloy powder may maintain the above-mentioned characteristics even when used as a structural material in engine combustion chambers.

Differing from conventional aluminum alloys reinforced by having the morphology of a dispersion of an $Al_{13}Fe_4$ phase and a small amount of an $Al_6Fe$ phase therein, the binary aluminum alloy powder sintered material of the invention is reinforced by precipitating a large quantity of an $Al_6Fe$ phase that is an intermetallic compound phase harder than a pure Al phase and stable within an assumable service temperature range (around 350° C.) and by grinding the grains of every phase to a size of from 70 to 80 nm or so.

According to the method for producing the binary aluminum alloy powder sintered material of the invention having the third characteristic aspect, the above-mentioned binary aluminum alloy powder sintered material that has both high strength and ductility even in a high-temperature environment can be produced.

BEST MODE FOR CARRYING OUT THE INVENTION

Figure 1:
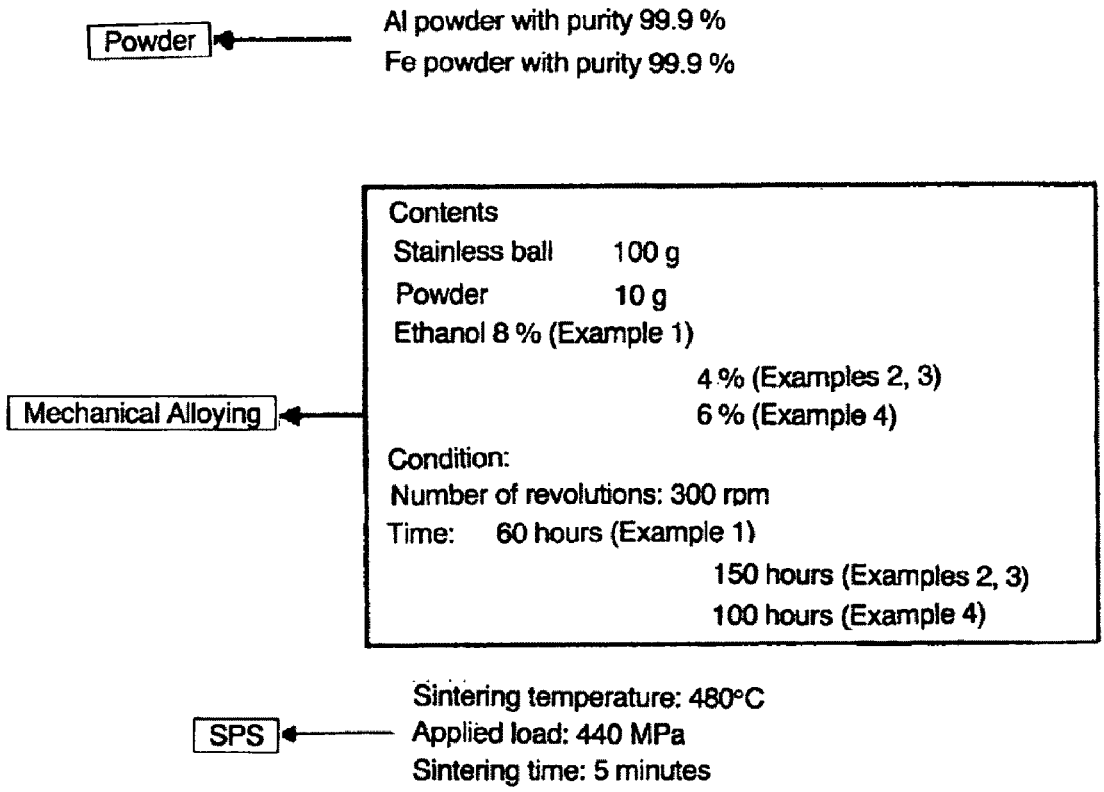
FIG. 1 is a flowchart of a solidification and shaping process in Examples 1 to 4.

In the following description, one unit for the time expression is 10 hours (except for the expression by minute), and one unit for the temperature expression is 10° C.

(1) Constitution of Microstructure:

The ratio by volume and the size in each phase shown in Table 2 below are presumed as follows:

<Ratio by Volume>

1) Coarse grain aluminum phase: This is presumed from the areal ratio in the SEM image of the sample, using an image analyzing software (Gatan digital micrograph).

2) $Al_6Fe$ phase: The powdery X-ray diffraction pattern after mechanical alloying is analyzed to estimate the concentration of Fe dissolving in the Al matrix, and the ratio by volume of the $Al_6Fe$ phase is computed according to the following formula 1. It is presumed that Fe having dissolved in aluminum in mechanical alloying is all precipitated as the $Al_6Fe$ phase.

$$V_f = \frac{27 \times 6 + 55.8}{55.8} \times \frac{2.89}{3.1} \times (\text{Fe(wt. \%)}) \quad \text{(Formula 1)}$$

3) $Al_{13}Fe_4$ phase: Based on the estimated result of Fe having dissolved in the matrix, this phase is computed according to the following formula 2. It is presumed that Fe not having formed the $Al_6Fe$ phase is to form the $Al_{13}Fe_4$ phase.

$$V_f = \frac{27 \times 13 + 55.8 \times 4}{55.8 \times 4} \times \frac{2.89}{3.7} \times (100 - \text{Fe(wt. \%)}) \quad \text{(Formula 2)}$$

<Size>

All phases are analyzed in transmission electronic microscope images.

By prolonging the time for mechanical alloying, the main second phase grains seen in the sintered body change from the $Al_{13}Fe_4$ phase to the semi-stable phase, $Al_6Fe$ phase (see Table 2).

Not heated up to around 600° C., the $Al_6Fe$ phase does not undergo phase transformation to the $Al_{13}Fe_4$ phase, and therefore, the material containing the $Al_6Fe$ phase as the second phase produces no problem in the service environment at around 350° C. that is presumed for use in car parts such as piston parts, even though it has a structure containing the $Al_6Fe$ phase.

The crystal grain size of the α-Al phase and the crystal grain size of the $Al_6Fe$ phase constituting the nanocrystalline phase reduce to give finer grains when the time for mechanical alloying is prolonged and when the amount of ethanol to be added is increased. With prolonging the time for mechanical alloying, the ratio by volume of the coarse grain aluminum phase increases.

To attain high strength and high compression ductility at room temperature, the crystal grains must be fine as in Table 2; however, especially in case where the ratio by volume of the $Al_6Fe$ phase therein is around 10%, an Al-5 at. % Fe alloy can express a strength almost reaching a level of 1 GPa when crystal grains of around 80 nm are dispersed therein.

On the other hand, however, further reduction in the size of the crystal grains to finer grains may rather tend to cause reduction in the ductility, and therefore the crystal grain size is preferably from 70 to 80 nm for taking a good balance between the strength and the ductility.

For expressing a strength of around 0.5 GPa at 350° C., it is suitable that the ratio by volume of the coarse grain aluminum phase is less than 5%, preferably less than 4%, more preferably at most 3%, even more preferably at most 2%.

In the Examples given below, the maximum amount of Fe capable of being forcedly dissolved by mechanical alloying is added, and the ratio by volume of the $Al_6Fe$ phase capable of being precipitated during the subsequent sintering is increased to the uppermost limit to thereby take advantage of the precipitation reinforcing effect to the maximum degree.

Figure 3:
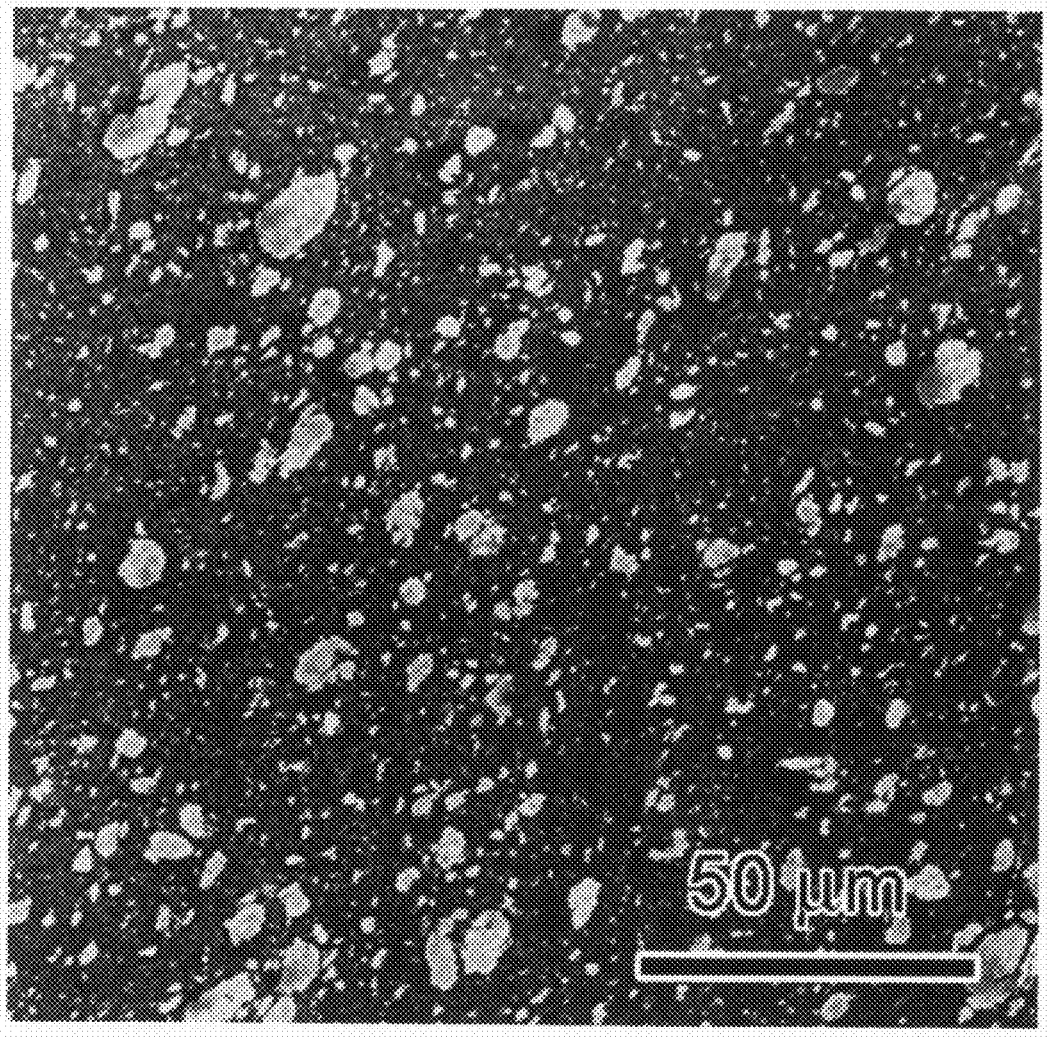
FIG. 3 is a SEM image showing the microstructure of the sintered body in Example 1.
Figure 4:
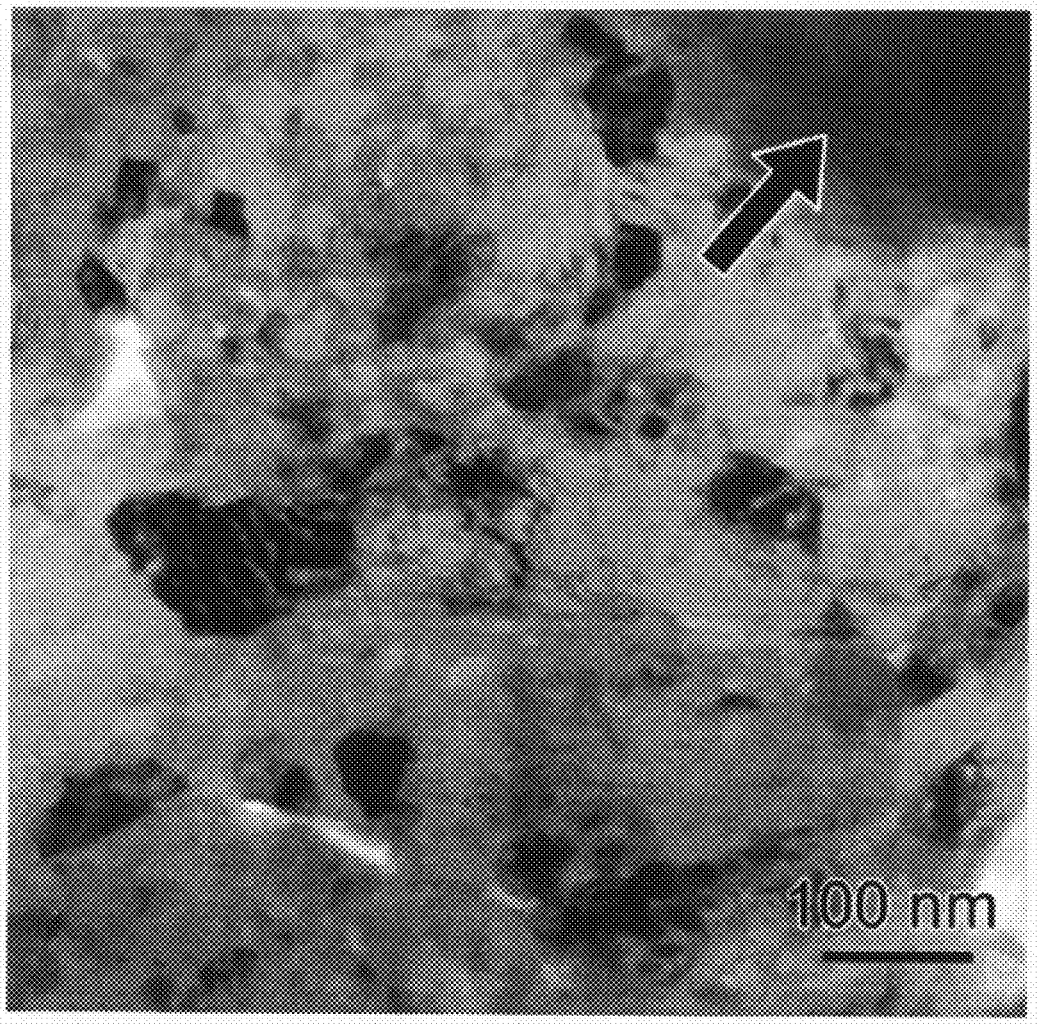
FIG. 4 is a BF-TEM image showing the microstructure of the sintered body in Example 1.
Figure 6:
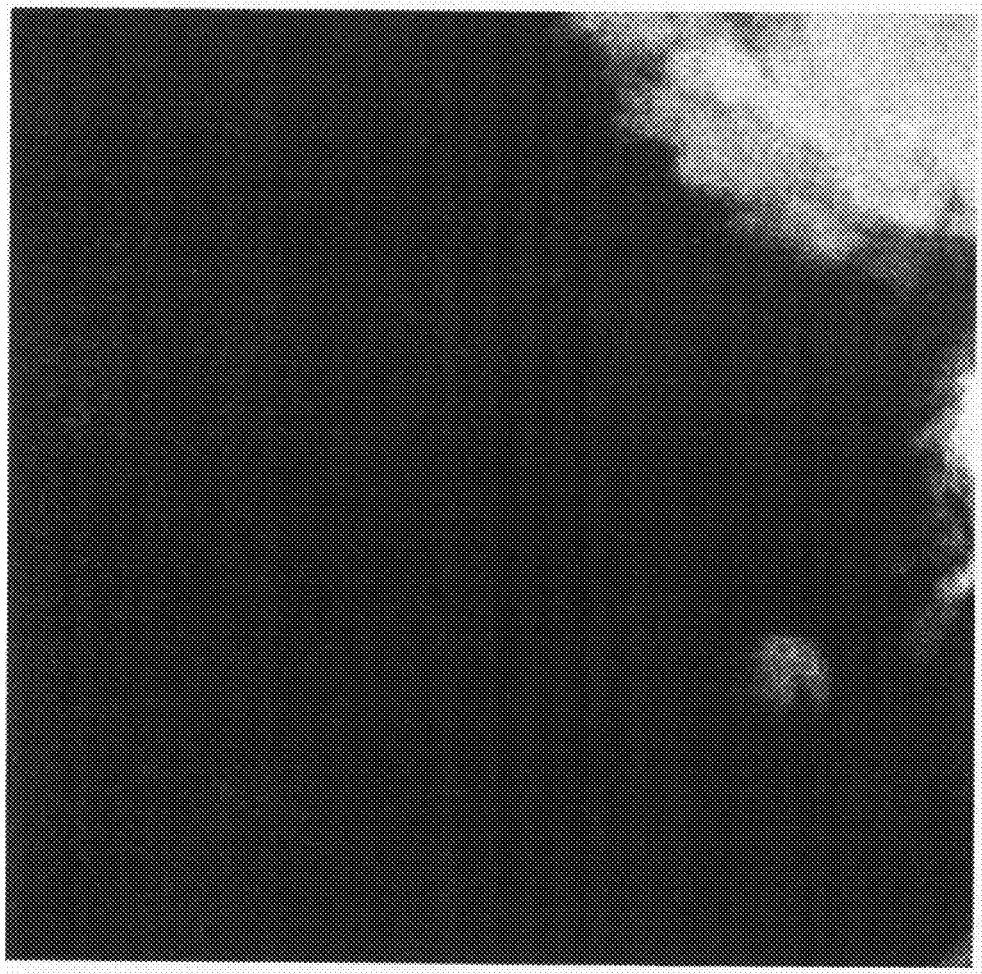
FIG. 6 is an Fe map showing the microstructure of the sintered body in Example 1.

(2) Time for Mechanical Alloying:

In case where the time for mechanical alloying is set for 60 hours, then many coarse $Al_{13}Fe_4$ phase grains of around a few tens μm in size comprising aggregates of nanocrystalline phases to detract from the ductility of the alloy precipitate, as is obvious from FIGS. 3, 4 and 6 relating to No. 3 (corresponding to Example 1). When the time for mechanical milling is short, then Al and Fe could not be fully mixed and therefore an Fe or Fe-rich intermetallic compound phases (AlFe phase, etc.) are formed; and after sintering, they become coarse $Al_{13}Fe_4$ phases to detract from the ductility of the alloy. On the other hand, each phase is refined to a nanoscale level, and therefore the alloy can express high strength near to around 1 GPa.

The microstructures formed by mechanical alloying for a prolonged period of 100 hours (No. 14) or 150 hours (No. 8, corresponding to Example 2) followed by sintering are shown in FIGS. 26 to 29 and FIGS. 9 to 12.

Figure 26:
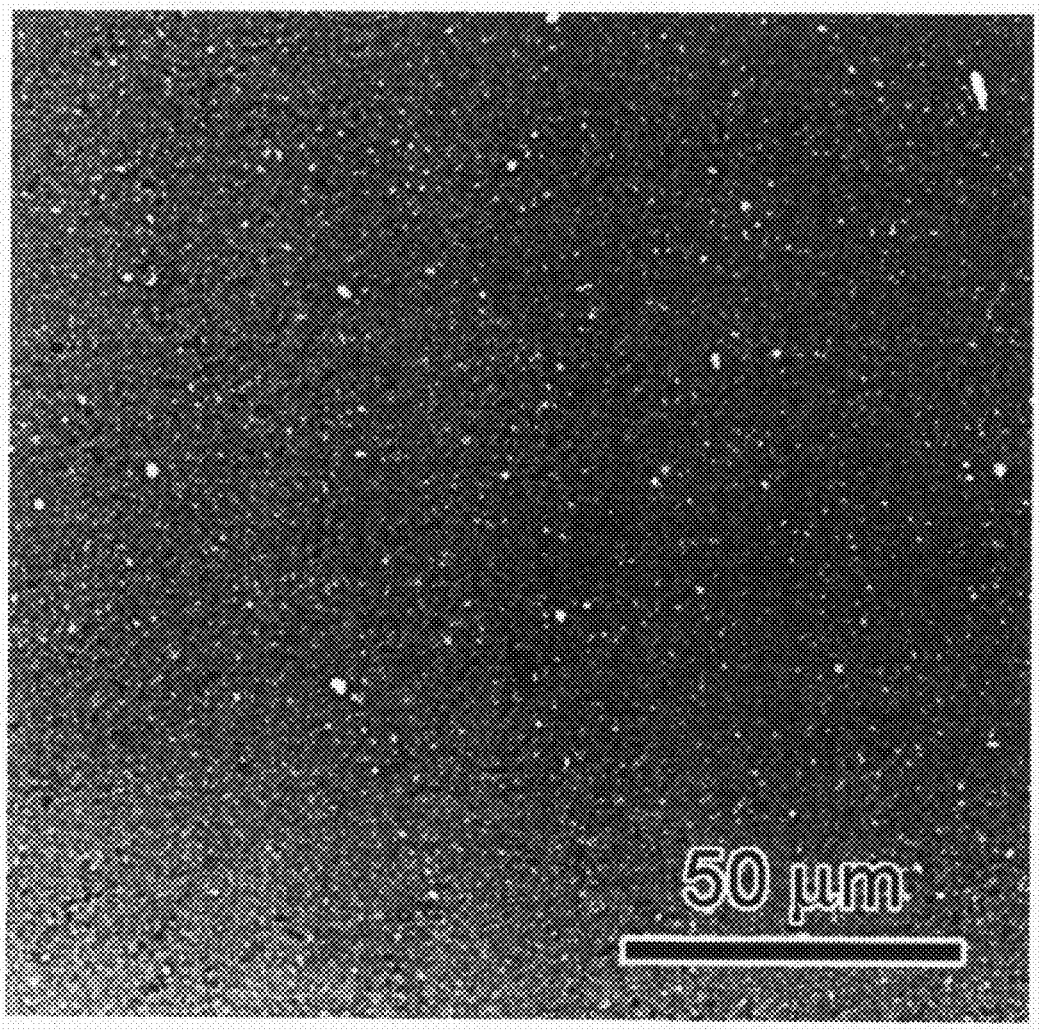
FIG. 26 is a SEM image showing the microstructure of the sintered body of No. 14 in Table 2.
Figure 27:
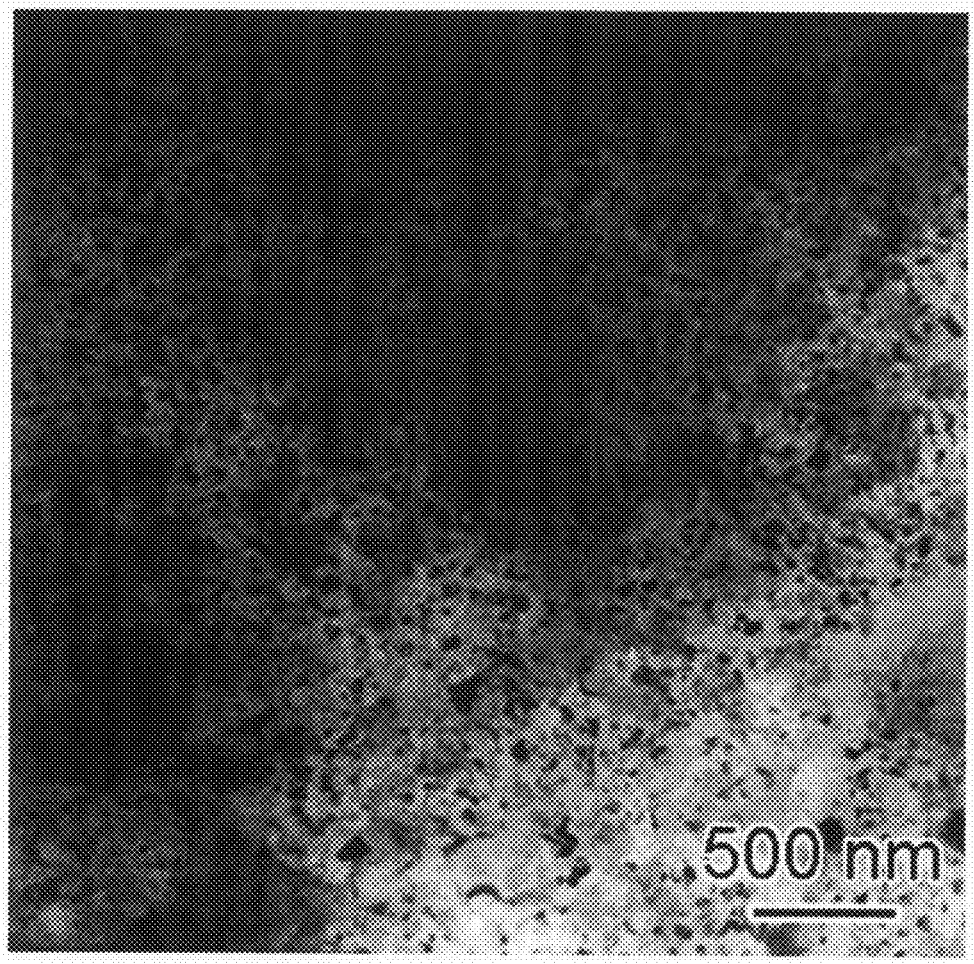
FIG. 27 is a BF-TEM image showing the microstructure of the sintered body of No. 14 in Table 2.
Figure 28:
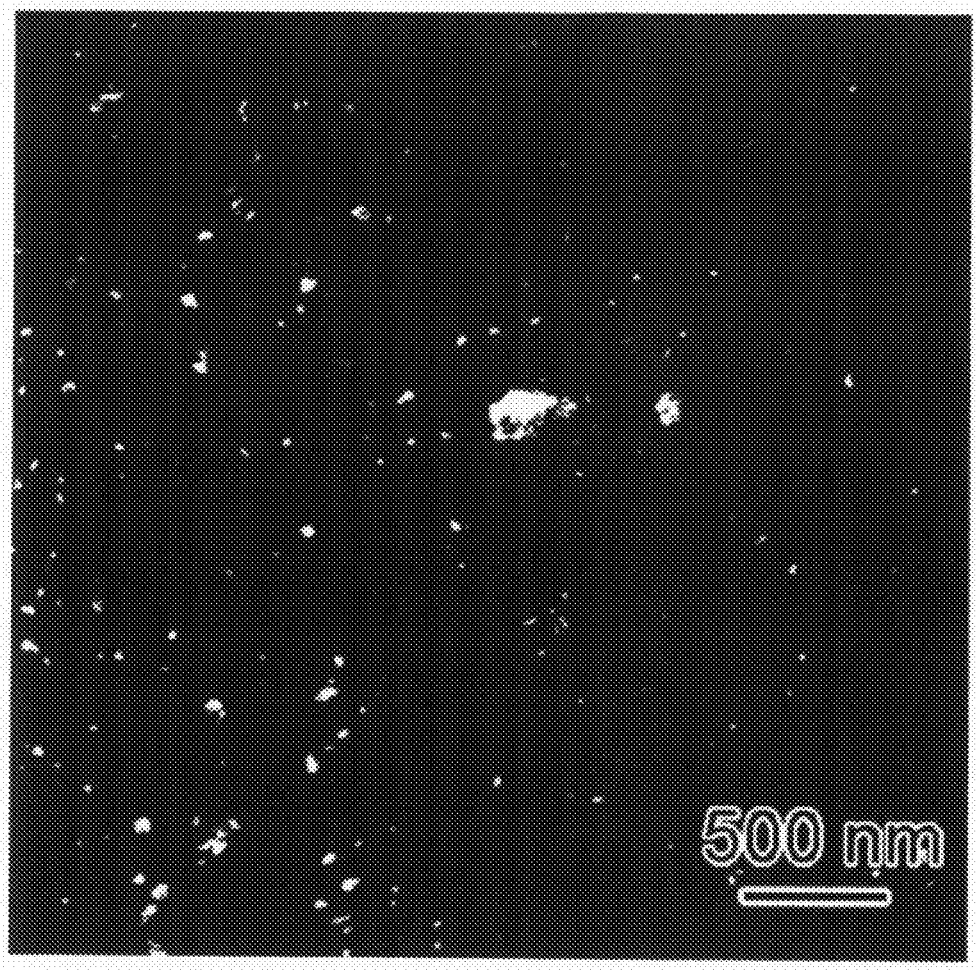
FIG. 28 is a DF-TEM image showing the microstructure of the sintered body of No. 14 in Table 2.
Figure 29:
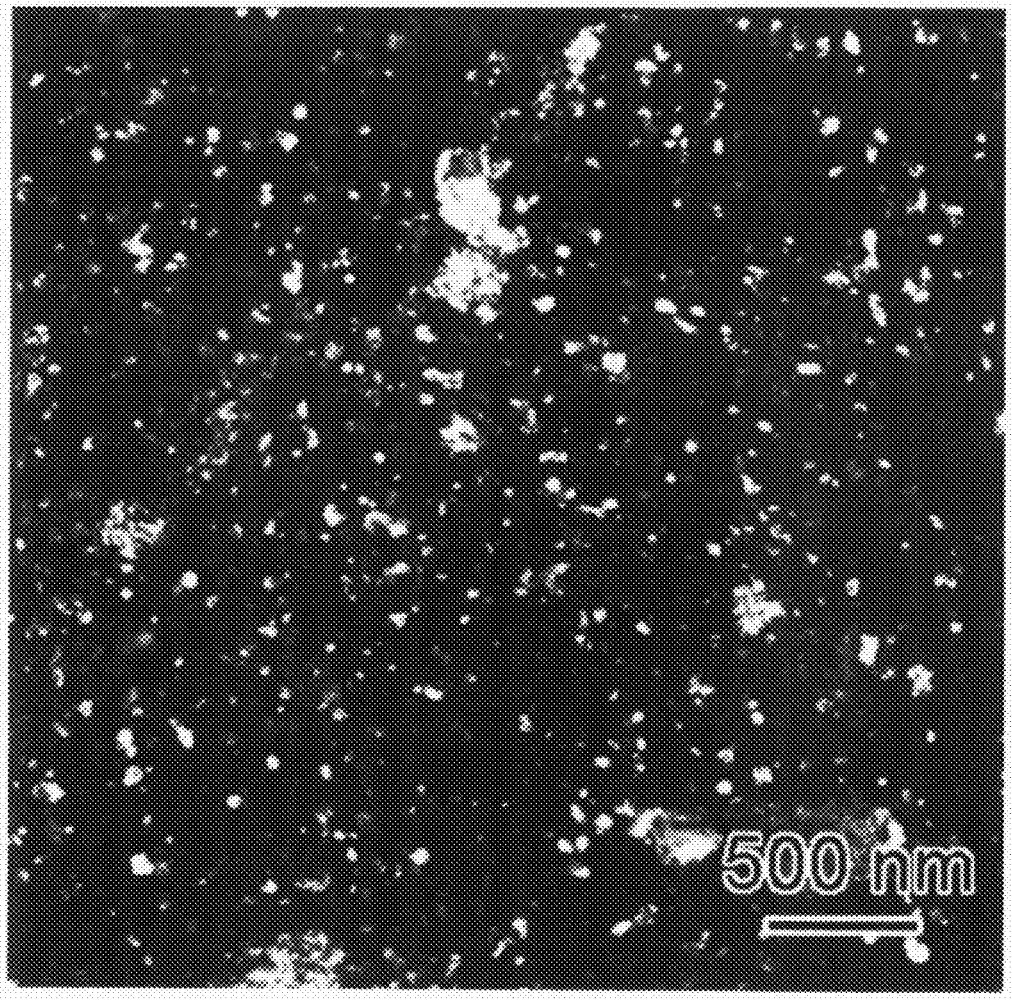
FIG. 29 is a DF-TEM image showing the microstructure of No. 14 in Table 2.

As confirmed from FIG. 26, the $Al_{13}Fe_4$ phase in the alloy after mechanical alloying for 100 hours is micro-refined. In the microstructure formed by mechanical alloying for 150 hours followed by sintering, the ratio by volume of the black contrast corresponding to the α-Al phase suggesting the presence of coarse grains (having a grain size of 1 μm or more) has increased up to around 10%, as in the SEM image in FIG. 9.

As confirmed from FIGS. 27 to 29 and 10 to 12, the microstructures of the nanocrystalline phases in Nos. 8 and 14 are both composite structures comprising α-Al phase and $Al_6Fe$ phase. Depending on the time for mechanical alloying, the constitutive phases of the structures vary and, in addition, the crystal grains may be refined into finer grains and the ratio by volume of the second phase, $Al_{13}Fe_4$ phase and $Al_6Fe$ phase varies.

Further reinforcement of the alloy is expected by the refinement of the crystal grains; but as in Table 2, the materials produced by mechanical alloying for 300 hours followed by sintering do not show ductility at all, and therefore, the refining time longer than required may cause reduction in the plastic transformation capability of the alloy.

(3) Amount of Ethanol to be Added in Mechanical Milling:

As is confirmed from the comparison between Nos. 3 and 5 in Tables 1 and 2, when the time for mechanical alloying is fixed to 60 hours and when the amount of ethanol to be added is varied to 4 or 8%, then the hardness and the strength of the alloy at room temperature tend to increase with the increase in the amount of ethanol added. From this, it may be considered that the larger amount of ethanol to be added may be effective for increasing the strength at room temperature of the alloy. It may be presumed that the same result could be obtained when the time for mechanical alloying is shorter or longer than 60 hours; and in fact, from the comparison between Nos. 6 and 8, and Nos. 12 to 14, it is confirmed that the presumed result can be obtained when the time for mechanical alloying is set for 150 hours and 100 hours.

On the other hand, the amount of ethanol to be added has a more significant influence on the ductility of the alloy than on the strength thereof, and therefore, especially from the viewpoint of maintaining the ductility, the amount of ethanol must be optimized. As confirmed from the comparison of the compressive behavior between Nos. 6 and 8 in Tables 1 and 2 and from the comparison of the compressive behavior between Nos. 12 to 14 therein, it is unfavorable to add 8% of ethanol for maintaining the ductility.

When the time for mechanical alloying is prolonged, the powder may solidify or may adhere to the inner wall of the pot owing to Cold welding during the process of mechanical alloying, depending on the amount of ethanol to be added; and in such a case, a good powder could not often be obtained. For example, when the powder was mechanical-alloyed for 100 to 150 hours with 2% ethanol added thereto, then it solidified and adhered to the inner wall of the pot, and therefore a good powder could not be obtained. When the amount of ethanol to be added is changed to 4% and the mechanical alloying under the condition may give a good powder, and in addition, the solidified material may have high strength and ductility. From these, the optimum amount of ethanol to be added for keeping good ductility at room temperature may be, for example, from more than 2% to less than 8% of the total mass of the powder, preferably from 4 to 6% as the tentative standard thereof.

(4) Temperature and Time for Discharge Plasma Sintering:

The sintering temperature and time to be set must be minimum necessary ones for obtaining a sintered body having a high density and having a good strength-ductility balance.

The material sintered at 420° C. for 5 minutes like No. 1 in Table 2 has the lowest density in the comparison between Nos. 1 to 3; however, regarding its compressive behavior, the material has a high strength almost reaching a level of 1 GPa, but it ruptures within an elastic range. Accordingly, the sintering at 420° C. detracts from the density and the ductility of the sintered material. From the comparison between Nos. 1 and 3, the density of the sintered body may increase owing to the elevation in the sintering temperature, but the hardness thereof tends to decrease; and it is presumed that further elevation in the sintering temperature brings about reduction in the strength of the material. From these and further taking the fact into consideration that the temperature may reach the serviceable limit of the tungsten carbide die and punch to be used, a temperature of up to 480° C. may be exemplified as a candidate for the limitative and suitable sintering temperature.

When the sintering time is prolonged to 15 minutes, any significant increase in the density does not occur but the hardness merely lowers, and the strength is difficult to maintain, which is confirmed from the comparison between Nos. 1 and 2. The reason for the reduction in the hardness may be because of the structure may be coarsened. Accordingly, it is understood that any unnecessary time should not be given to the process. The sintering time of 5 minutes at the sintering temperature of 480° C. employed in Example 3 given below may be a standard example of the optimum sintering time, taking the mechanical alloying time into consideration.

TABLE 1

| | Mechanical alloying (MA) | | | SPS | | | Property | |
|---|---|---|---|---|---|---|---|---|
| Lot | Ehtanol (%) | MA time (Hr) | Rotation (rpm) | Temp. (° C.) | Time (Hr) | Load (kN) | Density (g/cm$^3$) | Hardness HV |
| 1 | 8% | 60 | 300% | 420 | 5 | 35 | 2.67 | 247.5 |
| 2 | 8% | 60 | | 420 | 15 | 35 | 2.71 | 218.6 |
| 3 | 8% | 60 | | 480 | 5 | 35 | 2.79 | 257.2 |
| 4 | 4% | 60 | | 420 | 5 | 35 | 2.72 | 190.6 |
| 5 | 4% | 60 | | 480 | 5 | 35 | 2.75 | 177.4 |
| 6 | 8% | 150 | | 480 | 5 | 35 | 2.91 | 280.0 |
| 7 | 4% | 150 | | 420 | 5 | 35 | — | 244.0 |
| 8 | 4% | 150 | | 480 | 5 | 35 | 2.92 | 258.0 |
| 9 | 8% | 300 | | 420 | 5 | 35 | 2.83 | 287.0 |
| 10 | 8% | 300 | | 480 | 5 | 35 | 2.92 | 306 |
| 11 | 4% | 80 | | 480 | 5 | 35 | 2.82 | 211.5 |
| 12 | 4% | 100 | | 480 | 5 | 35 | 2.86 | 252.3 |
| 13 | 6% | 100 | | 480 | 5 | 35 | 2.89 | 266.5 |
| 14 | 8% | 100 | | 480 | 5 | 35 | 2.76 | 275.1 |

TABLE 2

| | | Microstructure | | | | | | Mechanical Prioerty | | | | |
|---|---|---|---|---|---|---|---|---|---|---|---|---|
| | | Nanocrystalline phase | | | | | c.g. | | Compressive behavior | | | |
| | | α-Al | $Al_6Fe$ | | $Al_{13}Fe_4$ | | α-Al | Hardness | $\sigma_{ys}$ (MPa) | | ε (%) | |
| Lot | | d, nm | d, nm | $V_1$, % | d, nm | $V_1$, % | $V_1$, % | HV | R.T. | 350° C. | R.T. | 350° C. |
| 1 | A | — | — | — | — | — | — | 247.5 | 1000* | 0 | — | — |
| 2 | A | — | — | — | — | — | — | 218.6 | — | — | — | — |
| 3 | A | 60 | N/A | 3.3 | 76 (16.2)a | 17.1 | 0 | 257.2 | 945 | 4.5 | 557 | 2 |
| 4 | B | — | — | — | — | — | — | 190.6 | — | — | — | — |
| 5 | B | 135 | 129 | 8.5 | — | 14.3 | 2.2 | 177.4 | — | — | — | — |
| 6 | B | 50 | 57 | 19.0 | — | 8.8 | 8.8 | 280.0 | 1082 | 1.9 | — | — |
| 7 | B | — | — | — | — | — | — | 244.0 | 984 | 22 | — | — |
| 8 | B | 80 | 89 | 18.5 | 105 (0.6)a | 9.1 | 8.9 | 258.0 | 992 | 28 | 334 | 26 |
| 9 | B | — | — | — | — | — | — | 287.0 | — | — | — | — |
| 10 | B | 32 | 44 | — | 84 (0.7)a | — | 9.2 | 306 | 1200 | 0 | — | — |
| 11 | B | 118 | — | 107 | — | — | 5.5 | 212 | 805 | 25 | — | — |
| 12 | B | 87 | 103 | 9.4 | — | 13.8 | 5.8 | 252 | 985 | 17 | 388 | 20 |
| 13 | B | 76 | 92 | 14 | — | 9.3 | 2.3 | 267 | 1092 | 14 | 488 | 23 |
| 14 | B | 53 | 65 | 9.1 | — | 14.0 | 0 | 275 | 1083 | 2 | 551 | 18 |

Remarks:

c.g. α-Al: coarse grain α-Al phase.

A: This indicates that the constitutive phases are α-Al phase and $Al_{13}Fe_4$ phase.

B: This indicates that the constitutive phases are α-Al phase and $Al_6Fe$ phase.

In the Tables, * indicates the fracture stress.

( ) a means the size (μm) of the aggregate.

EXAMPLE 1

No. 3 in Tables 1 and 2 is Example 1

As in FIG. 1, using an aluminum powder having a purity of 99.9% and a pure iron powder having a purity of 99.99% as the starting materials, these were mechanical-alloyed. For the mechanical alloying, a commercially-available planetary ball mill was used, and the pot and the balls were formed of stainless steel.

The mixed powder was taken to be in a ratio by mass to the stainless balls of 10/1, and 8% of ethanol, relative to the powder mass, was added thereto. Then, the chamber was closed in an argon atmosphere, and then the material was mechanical-alloyed therein. The mechanical alloying condition was 300 rpm and 60 hours in total.

After the mechanical alloying, the powder was put into a tungsten carbide mold having an inner diameter of 10 mm, and solidified therein using a commercially-available discharge plasma sintering device (by SPS Syntex). The solidification was in vacuum of at most $10^{-3}$ Pa, the applied load was 35 kN (corresponding to 440 MPa as the solidification stress), the retention time was 5 minutes, and the temperature was 480° C.

Figure 2:
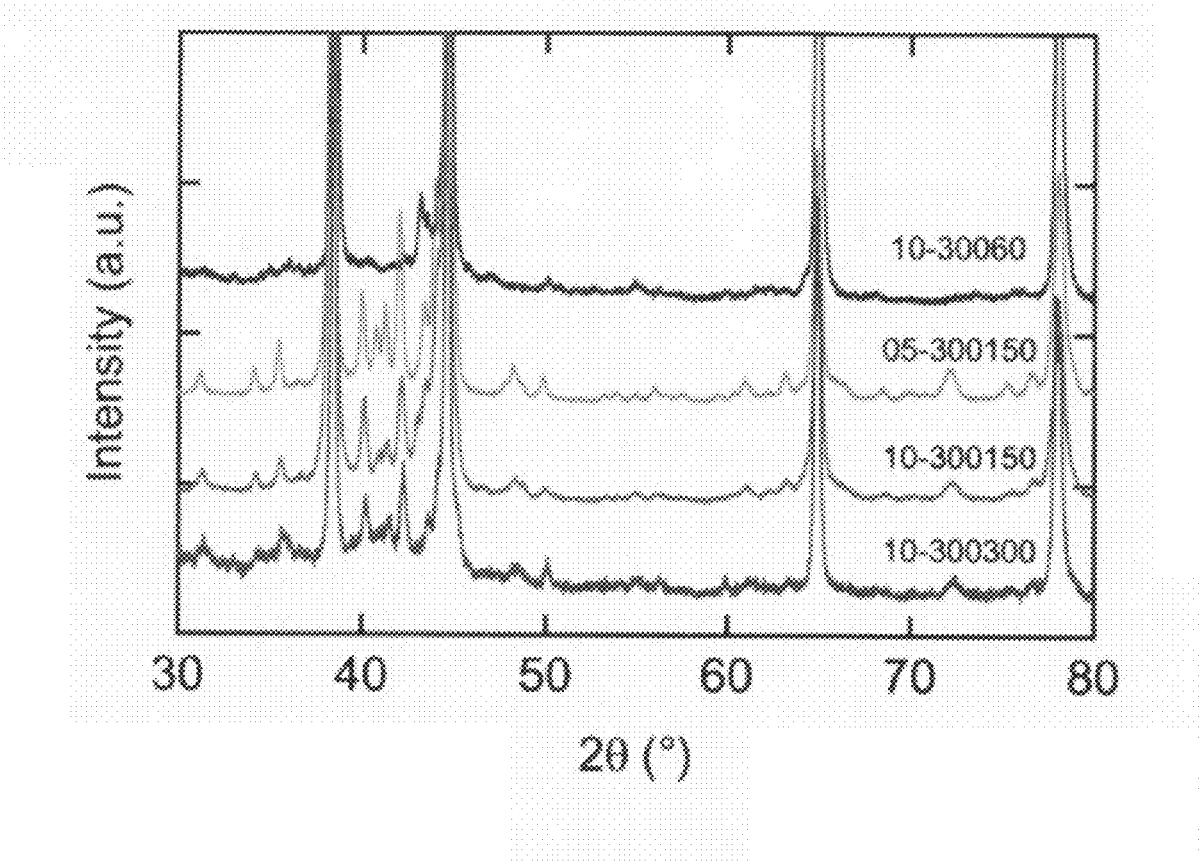
FIG. 2 shows X-ray diffraction patterns of developed alloys (Al-5 at. % Fe) in Examples 1 to 4.

The bulky material obtained after the solidification was analyzed through X-ray diffractometry, and, as a result, as in FIG. 2, this gave a peak of $Al_{13}Fe_4$ phase not given by the powder just after the mechanical alloying. In addition, as in FIG. 3, the structure had nanocrystalline $Al_{13}Fe_4$ phase aggregates of from a few tens μm to 1 μm or so in size, as distributed in the aluminum matrix.

Figure 5:
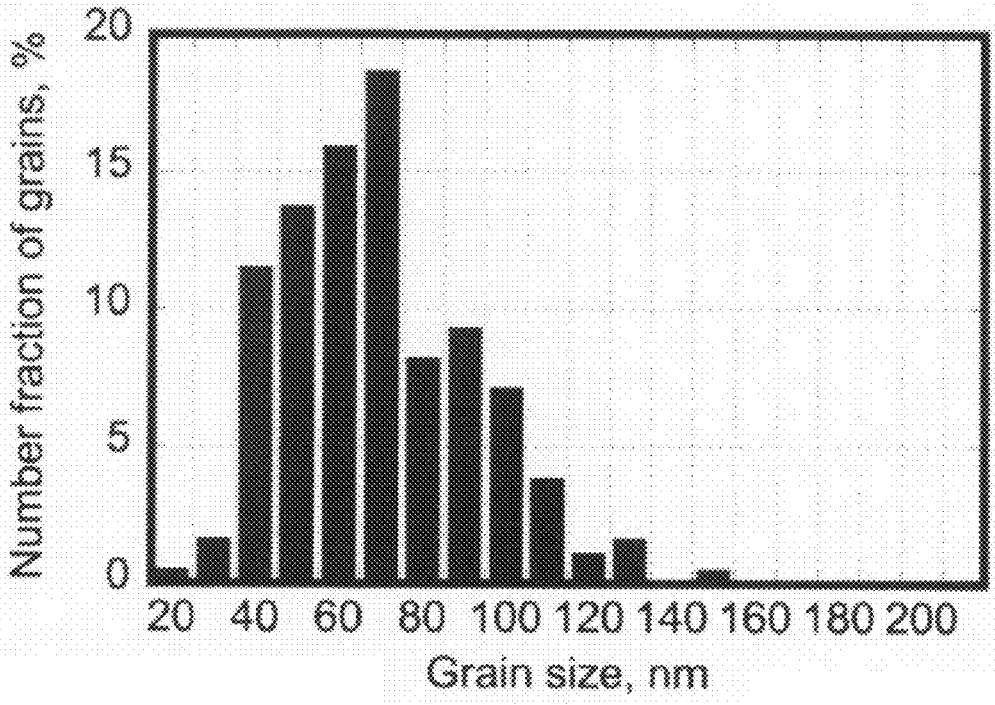
FIG. 5 is a histogram showing the crystal grain size distribution of the α-Al phase in the sintered body in Example 1.

As in FIGS. 4 and 5, the aluminum matrix has a crystal grain size of around 60 nm. On the other hand, the existence of iron in the aluminum matrix could not be confirmed; and no iron could be detected in EDS analysis of the aluminum matrix shown in FIG. 6. From these, it is understood that almost all iron contributed toward formation of the $Al_{13}Fe_4$ phase. The nanocrystalline phase having the black contrast shown by the arrow in FIG. 4 is identified as the $Al_{13}Fe_4$ phase, when the image is compared with that in FIG. 6, and it is also understood that the coarse $Al_{13}Fe_4$ phase is an aggregate of nanocrystals.

Figure 7:
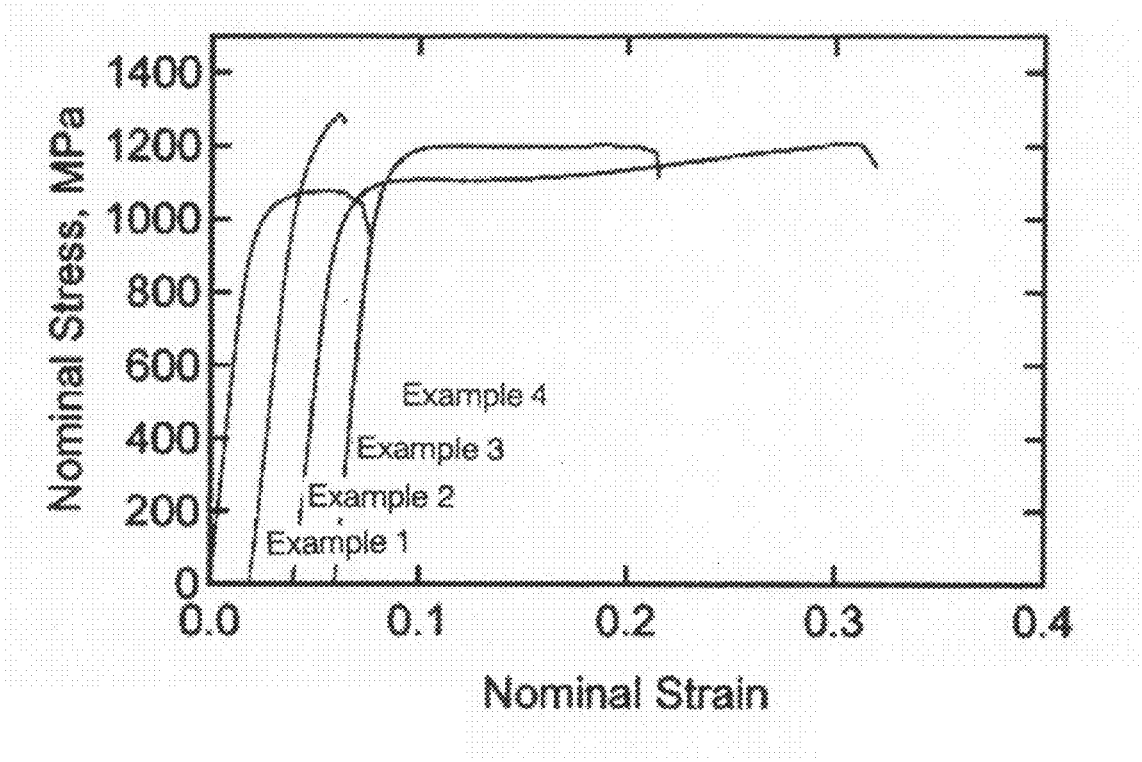
FIG. 7 is a compression strain-stress curve of the sintered bodies in Examples 1 to 4.
Figure 8:
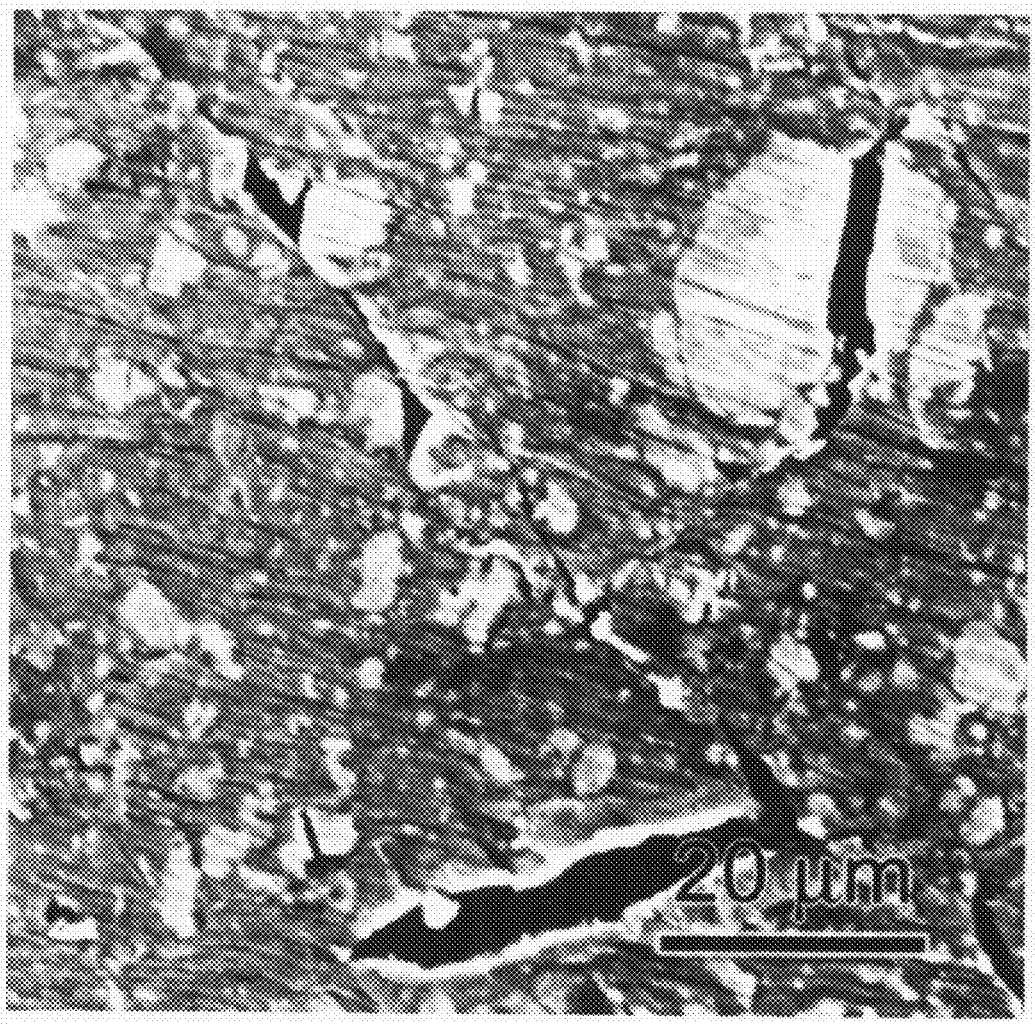
FIG. 8 is a SEM image showing the alloy surface of the disrupted, sintered body in Example 1.

The bulk material was tested for compression. As in FIG. 7, the material has a high compression strength on a level of around 960 MPa; however, they were broken after having a compression strain of 4.5%, and they could not have a high ductility. FIG. 8 shows a SEM image of the surface of the disrupted alloy, in which the coarse $Al_{13}Fe_4$ phases were disrupted, and it may be considered that the disruption would have promoted the development of cracks therefore causing the reduction in the compression strain.

The hardness, the compressive behavior and the ratio by volume and the size of the constitutive phases of the solidified material as obtained herein are shown in Table 2. Nos. 1, 2, 4 and 5 are test examples for which the mechanical alloying time was set the same as that for the sample in Example 1. The influence of the sintering time and the ethanol addition on these examples is confirmed from the comparison between them.

EXAMPLE 2

No. 6 in Tables 1 and 2 is Example 2

A bulk material was produced under the same condition as in Example 1, for which, however, the mechanical alloying time only of the process condition in Example 1 was changed to 150 hours.

The bulk material was analyzed through X-ray diffractometry. Different from the case where the mechanical alloying time was 60 hours, this gave a peak of $Al_6Fe$ phase not given by the powder just after the mechanical alloying, in addition to the peak of $Al_{13}Fe_4$ phase, as in FIG. 2.

Figure 9:
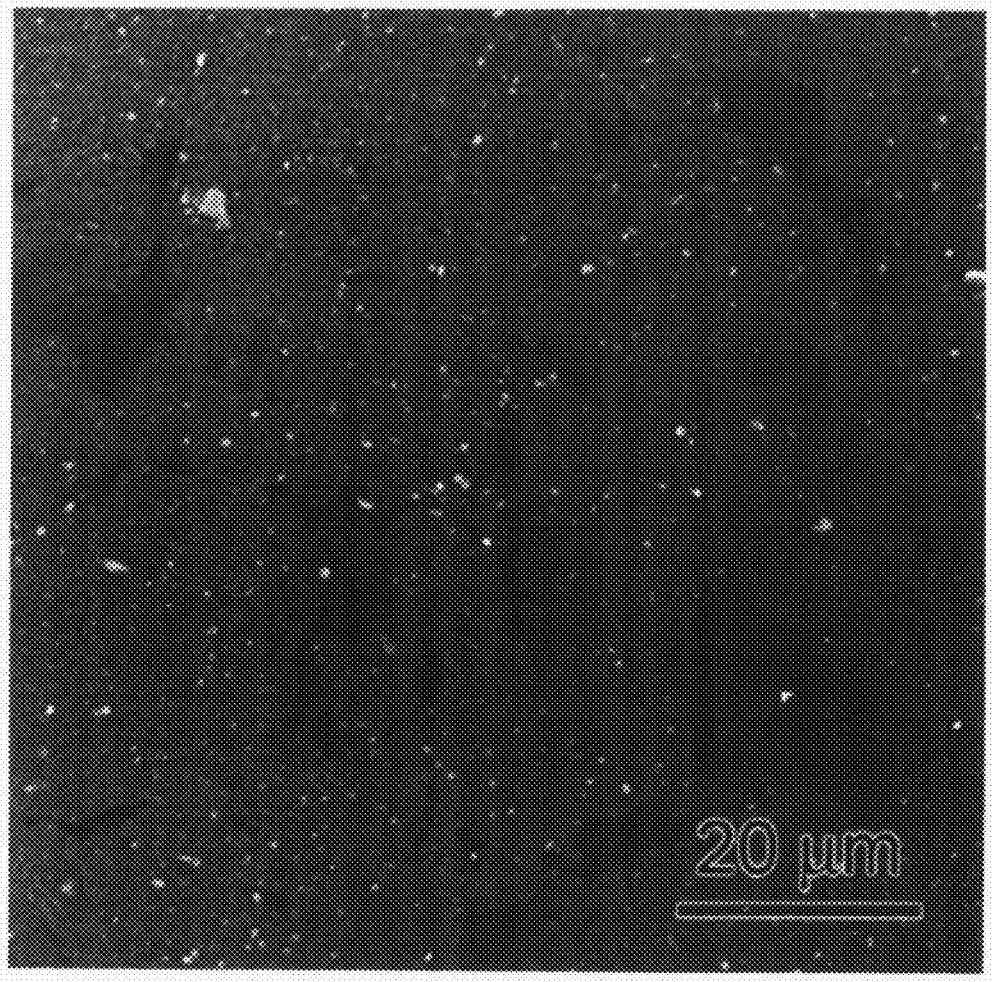
FIG. 9 is a SEM image showing the microstructure of the sintered body in Example 2.
Figure 10:
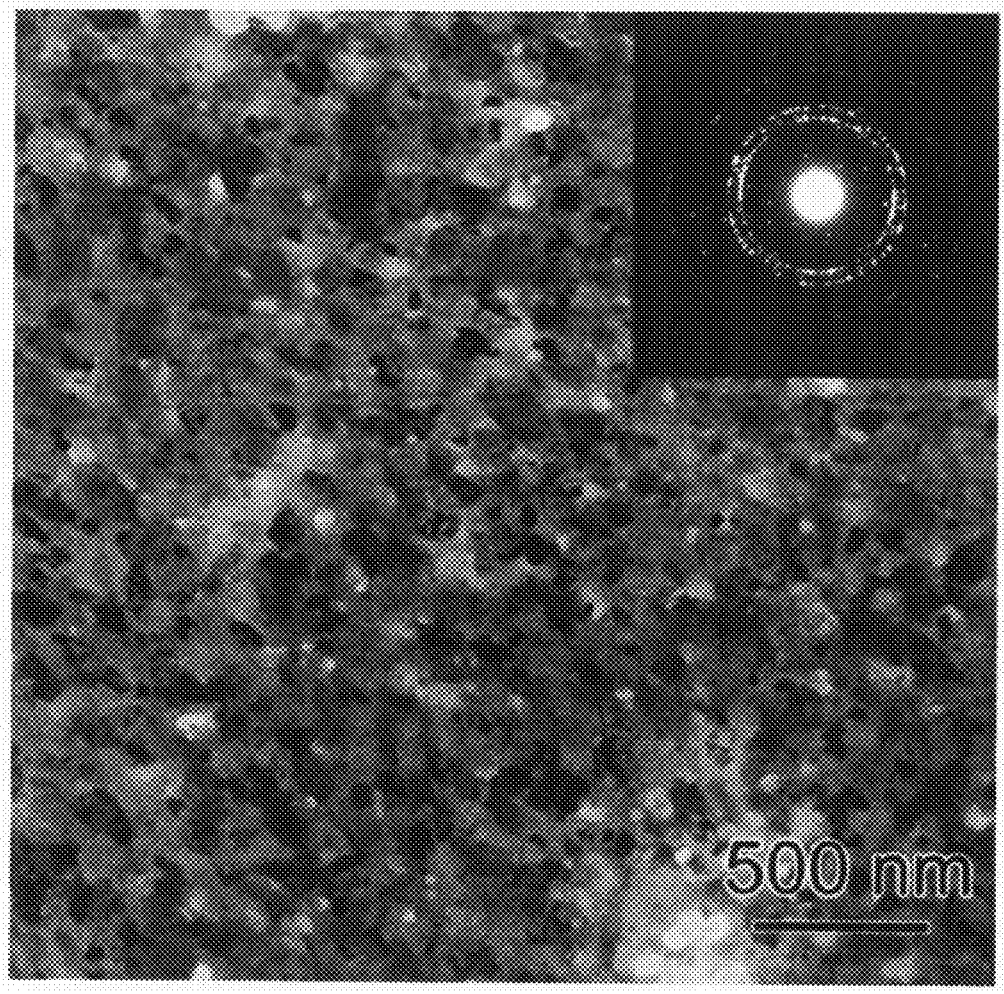
FIG. 10 is a BF-TEM image showing the microstructure of the sintered body in Example 2.
Figure 11:
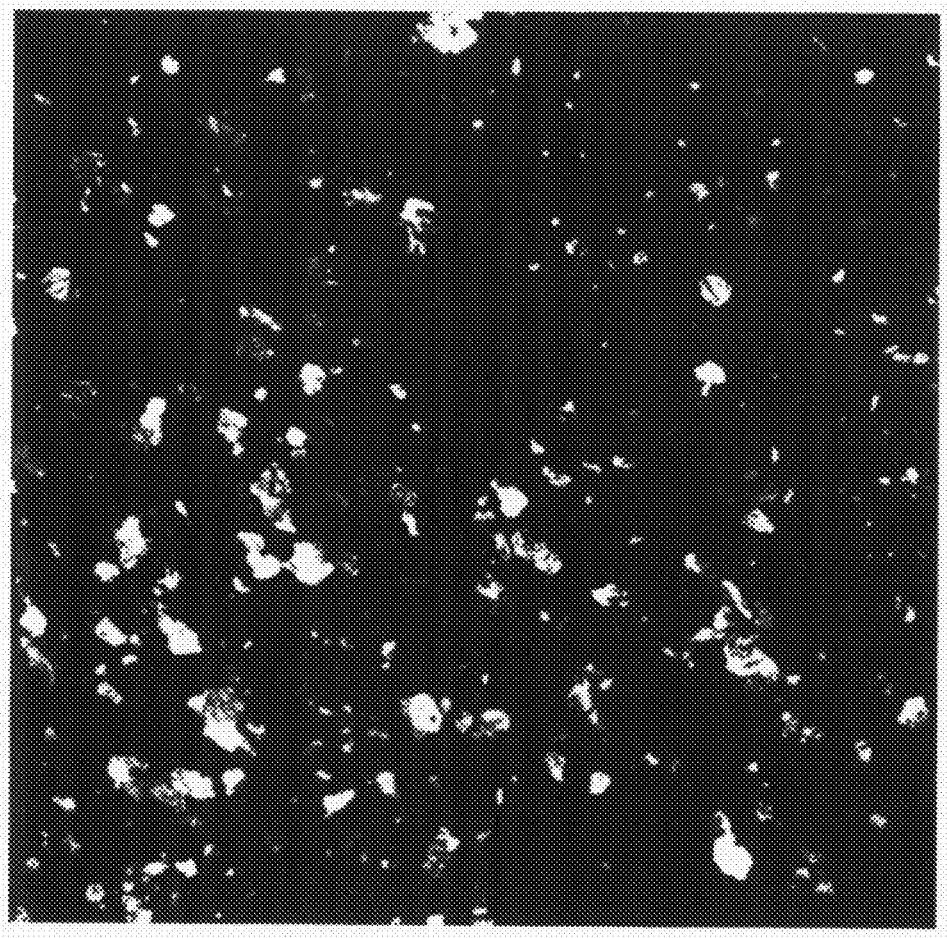
FIG. 11 is a DF-TEM image showing the microstructure of the sintered body in Example 2.
Figure 12:
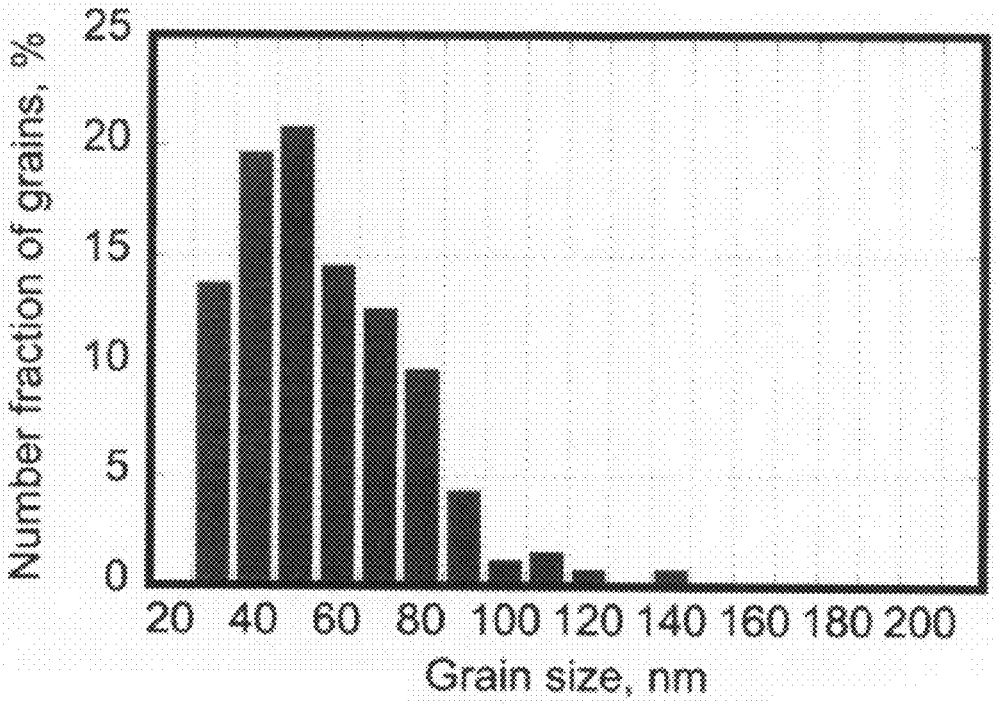
FIG. 12 is a histogram showing the crystal grain size distribution of the α-Al phase in the sintered body in Example 2.

As in FIG. 9, there exists a black contrast (α-Al phase) around the gray contrast in the structure, different from that in the case of mechanical alloying of 60 hours, and fine $Al_{13}Fe_4$ phase grains of at most 1 μm in size disperse therein. The ratio by volume of the α-Al phase is around 9%. As in FIG. 10, the region shown by the gray contrast comprises a nanocrystalline phase. From FIGS. 11 and 12, it is known that the region comprises a composite phase structure of α-Al phase grains and $Al_6Fe$ phase grains having a crystal grain size of around 50 nm.

The bulk material was tested for compression. As in FIG. 7, the material expressed an extremely high yield strength on a level of around 1.2 GPa, and after elastic deformation, it immediately broke. The fracture stress at break was on a level of around 1.3 GPa. After broke, the material became a powder.

The hardness, the compressive behavior and the ratio by volume and the size of the constitutive phases of the solidified material as obtained herein are shown in Table 2.

EXAMPLE 3

No. 8 in Tables 1 and 2 is Example 3

A bulk material was produced under the same condition as in Example 2, for which, however, the amount of ethanol to be added to the powder before mechanical milling of the process condition in Example 2 was changed to 4% of the powder mass.

The bulk material was analyzed through X-ray diffractometry. Different from the case where the mechanical alloying time was 60 hours, this gave a peak of $Al_6Fe$ phase not given by the powder just after the mechanical alloying, in addition to the peak of $Al_{13}Fe_4$ phase, as in FIG. 2.

Figure 13:
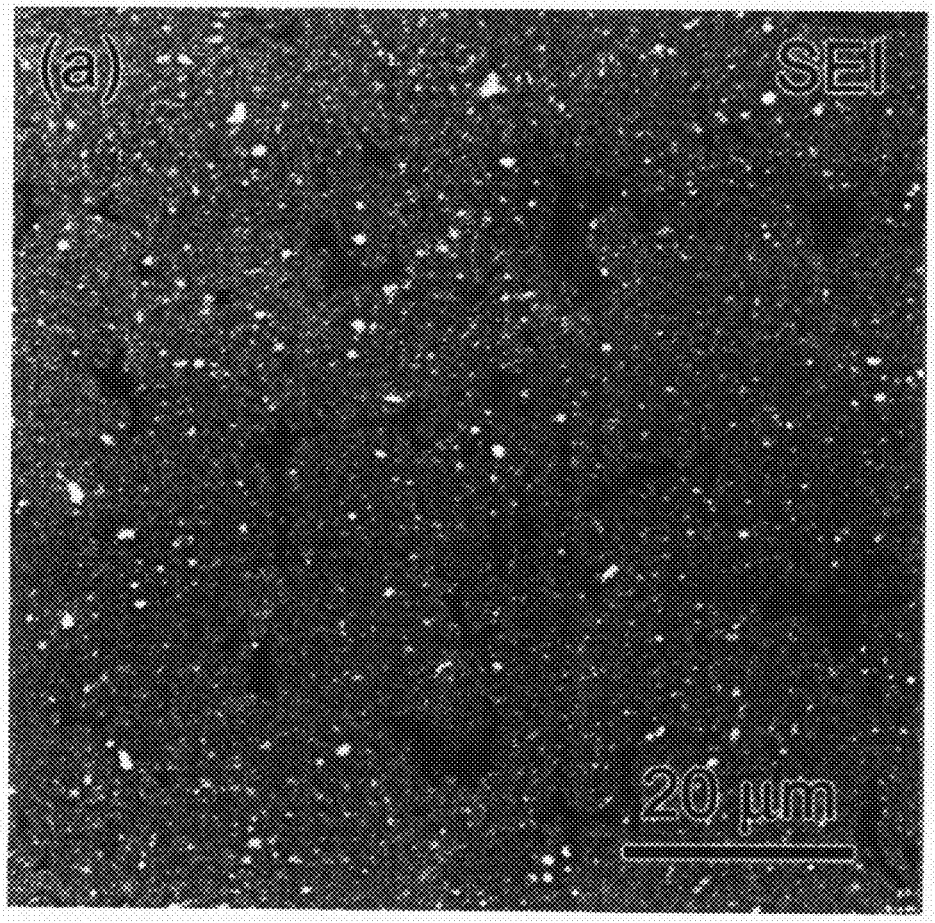
FIG. 13 is a SEM image showing the microstructure of the sintered body in Example 3.

As in FIG. 13, the structure is extremely similar to that of the bulk material in Example 2. The ratio by volume of the α-Al phase with the black contrast is around 8.8%.

Figure 14:
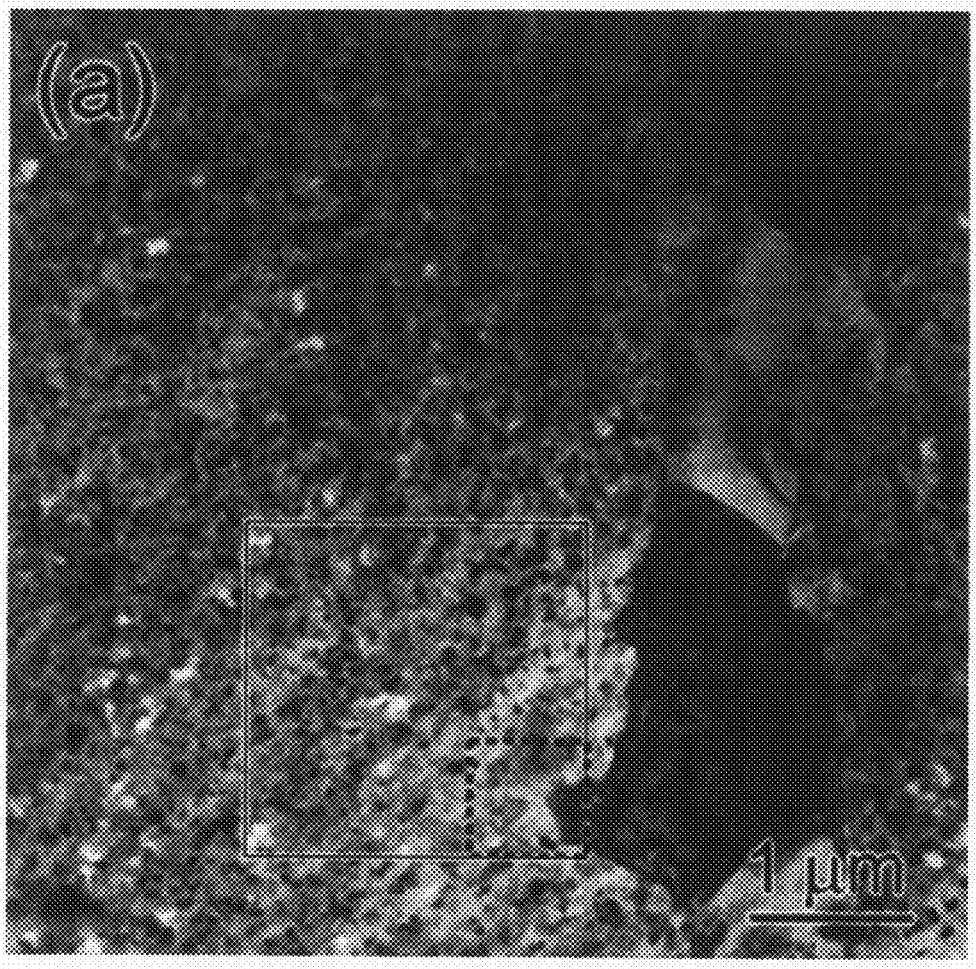
FIG. 14 is a BF-TEM image showing the microstructure of the sintered body in Example 3.
Figure 15:
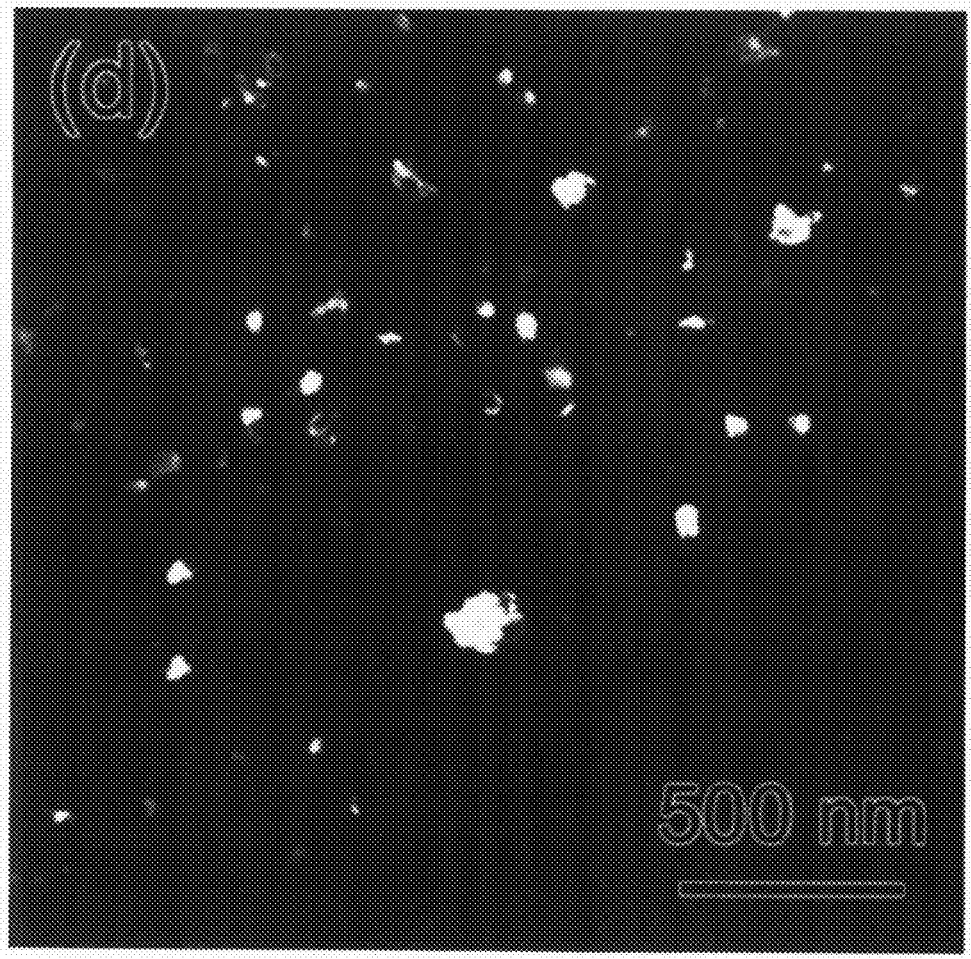
FIG. 15 is a DF-TEM image showing the microstructure of the sintered body in Example 3.
Figure 16:
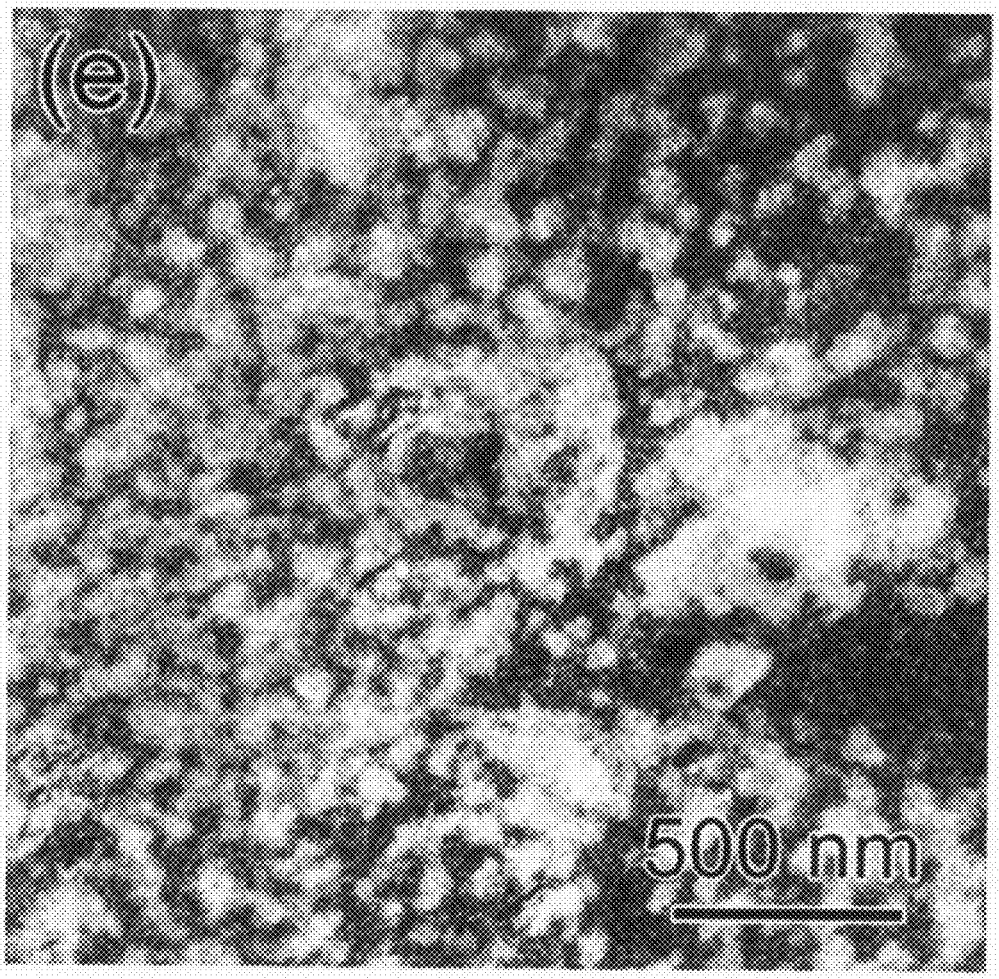
FIG. 16 is an Fe map showing the microstructure of the sintered body in Example 3.

As in FIG. 14, the crystals of the α-Al phase have a crystal grain size of from 2 to 3 μm or so. From FIGS. 15 and 16, it is known that the region with the gray contrast comprises a composite phase structure of an α-Al phase having a crystal grain size of around 80 nm as the mother phase and an $Al_6Fe$ phase dispersed in the mother phase. The ratio by volume of the $Al_6Fe$ phase and the $Al_{13}Fe_4$ phase in the composite phase structure is around 27% in total.

Figure 17:
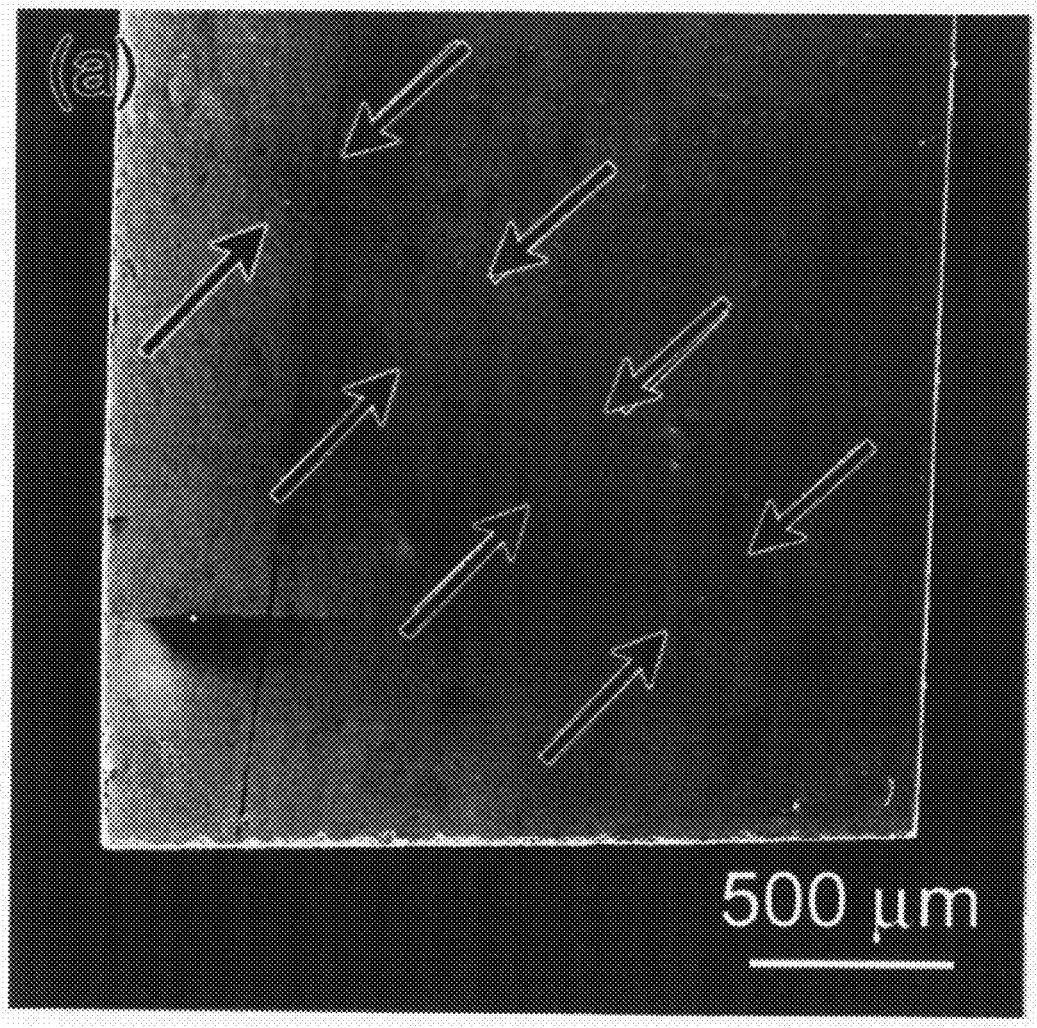
FIG. 17 is a SEM image showing the condition of concentrated deformation of the microstructure of the sintered body in Example 3.
Figure 18:
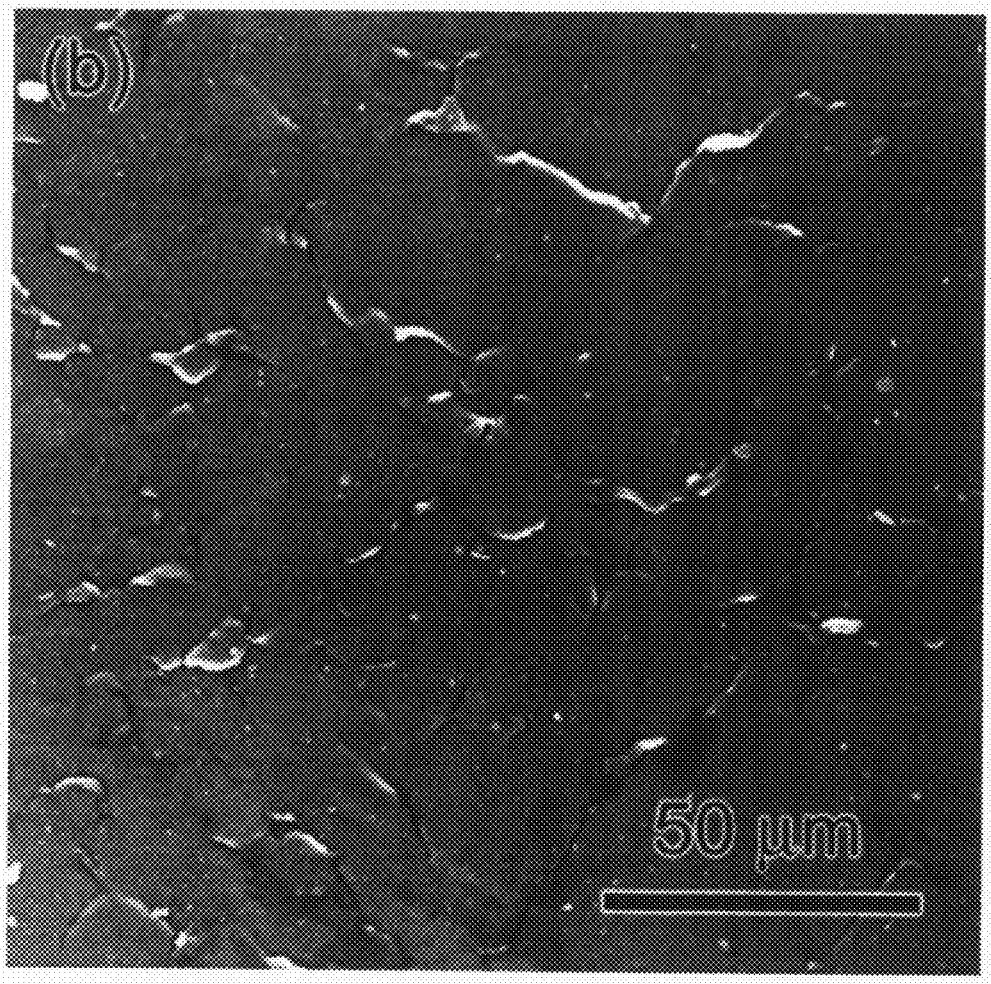
FIG. 18 is a SEM image showing the deformation of the α-Al phase in the microstructure of the sintered body in Example 3.
Figure 19:
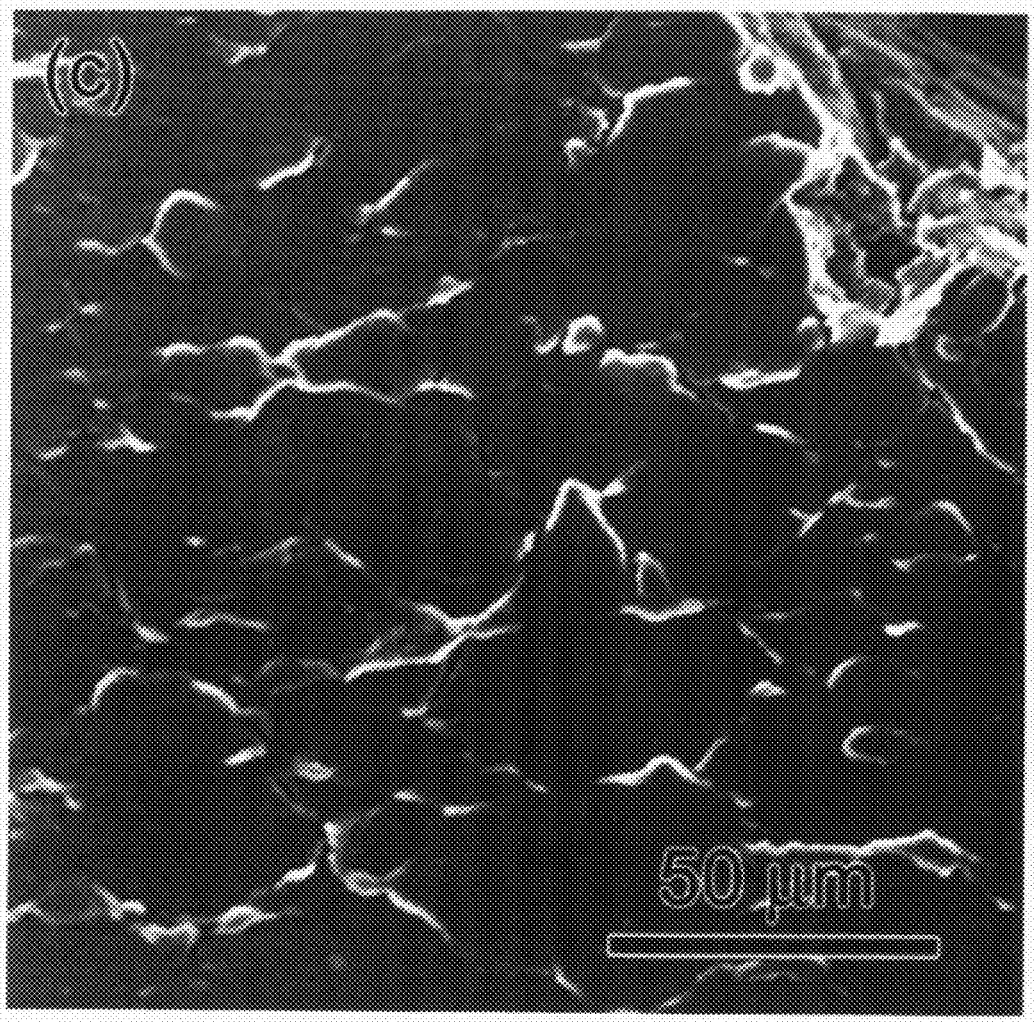
FIG. 19 is a SEM image showing the interfacial cleavage of the α-Al phase in the microstructure of the sintered body in Example 3.

The bulk material was tested for compression. As in FIG. 7, the material expressed an extremely high yield strength on a level of around 1.0 GPa, and exhibited a compression stress of at least 0.2. The deformation process and the fractured face of the bulk material were analyzed through SEM, and as in FIG. 17, prior to fracture thereof, the deformation concentrated in the directions as inclined by 45 degrees in the compression direction, as shown by the arrows. In the region where the deformation concentrated, the coarse α-Al phases first deformed, as in FIG. 18, and thereafter the interface between the coarse α-Al phase and the nanocrystalline phase cleaved, as in FIG. 19, thereby bringing about the fracture of the material.

Figure 20:
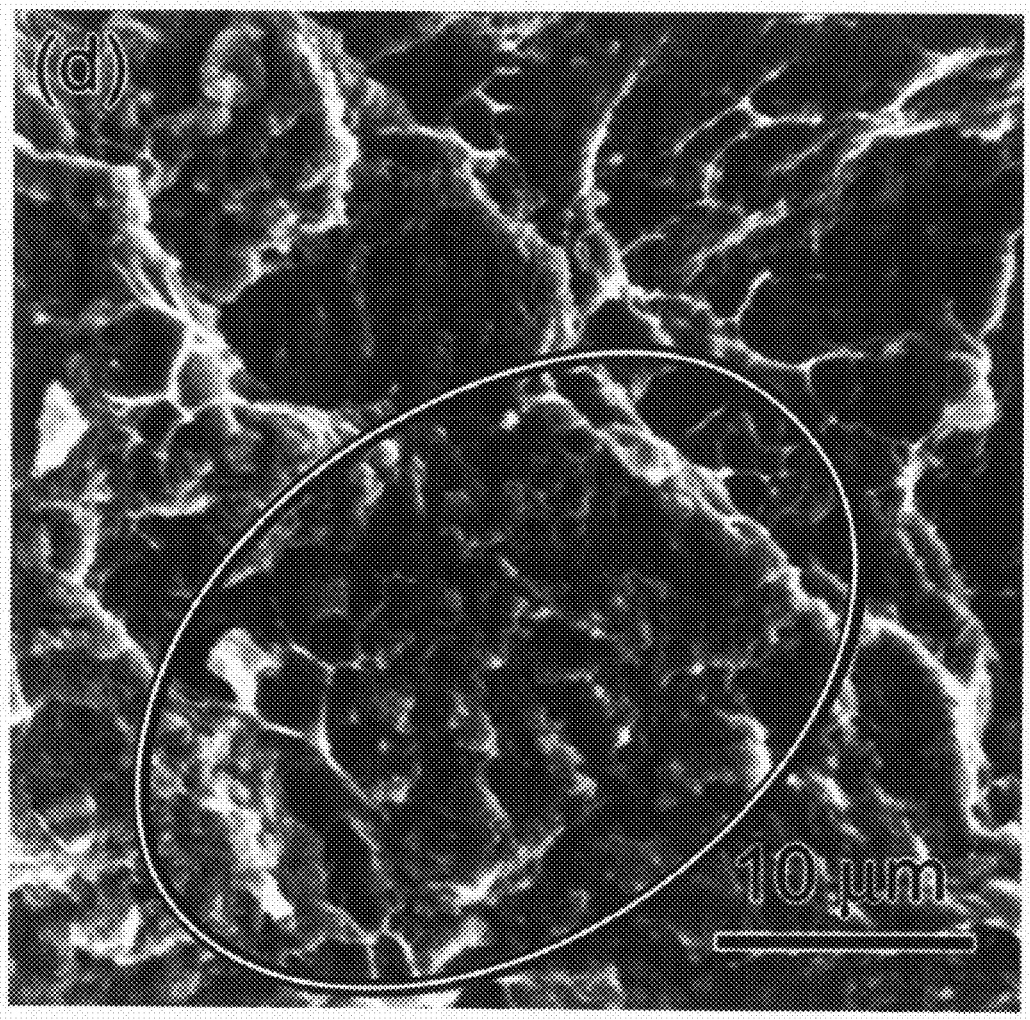
FIG. 20 is a SEM image showing the nanocrystal region to undergo brittle fracture in the microstructure of the sintered body in Example 3.

From the profile of the fractured face in the region surrounded by the oval in FIG. 20, it is confirmed that the periphery of the nanocrystalline region to undergo brittle fracture is surrounded by dimples expected to be derived from a coarse Al phase; and it is considered that the deformation of the coarse Al phase would bring about great plastic strain.

The hardness, the compressive behavior and the ratio by volume and the size of the constitutive phases of the solidified material as obtained herein are shown in Table 2.

EXAMPLE 4

No. 13 in Tables 1 and 2 is Example 4

A bulk material was produced under the same condition as in Examples 1 to 3, for which, however, the amount of ethanol to be added to the powder before mechanical milling was changed to 6% of the powder weight and the mechanical alloying time was changed to 100 hours, among the process condition in Example 3.

The bulk material was analyzed through X-ray diffractometry. Different from the case where the mechanical milling time was 60 hours, this gave a peak of $Al_6Fe$ phase not given by the powder just after the mechanical milling, in addition to the peak of $Al_{13}Fe_4$ phase, as in FIG. 2.

Figure 21:
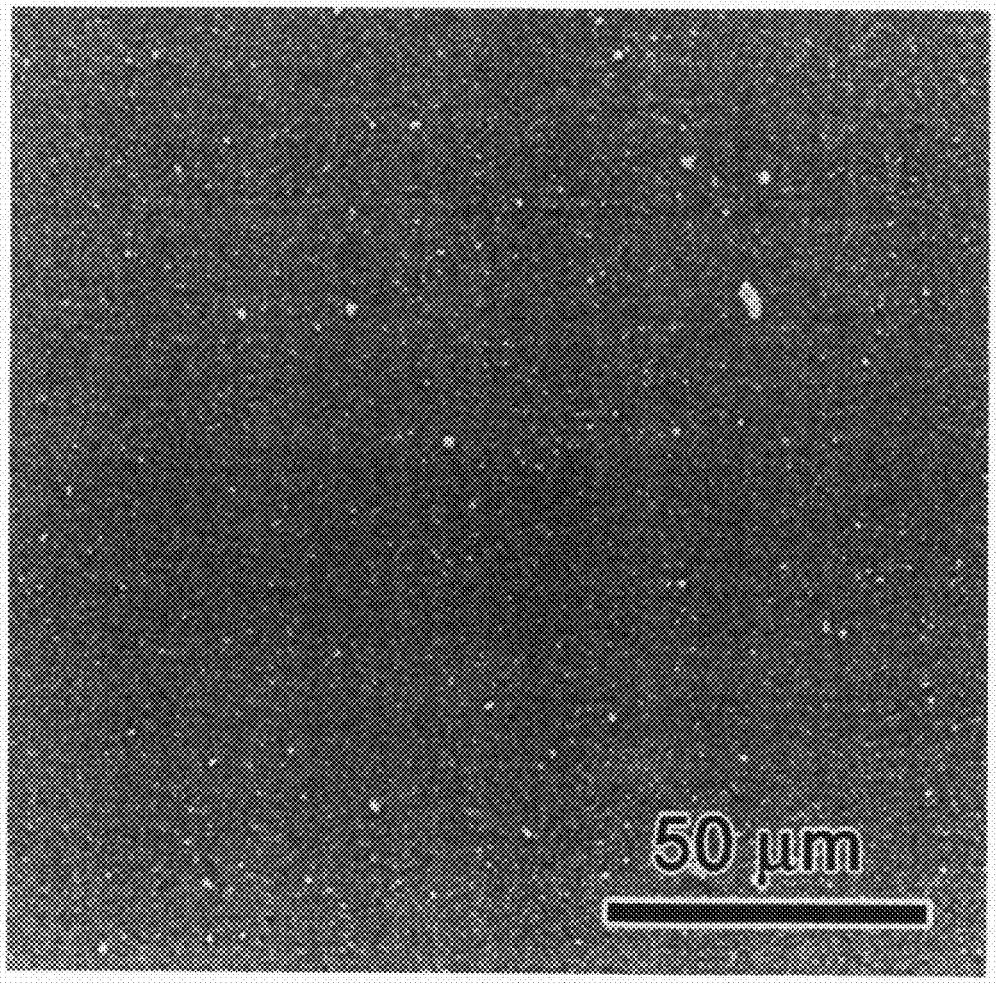
FIG. 21 is a SEM image showing the microstructure of the sintered body in Example 4.

As in FIG. 21, the structure is extremely similar to that of the bulk material in Examples 2 and 3. On the other hand, different from the bulk material in Examples 2 and 3, the ratio by volume of the α-Al phase with the black contrast is at most 3%. The α-Al phase grains have a grain size on a level of around 1 μm.

Figure 22:
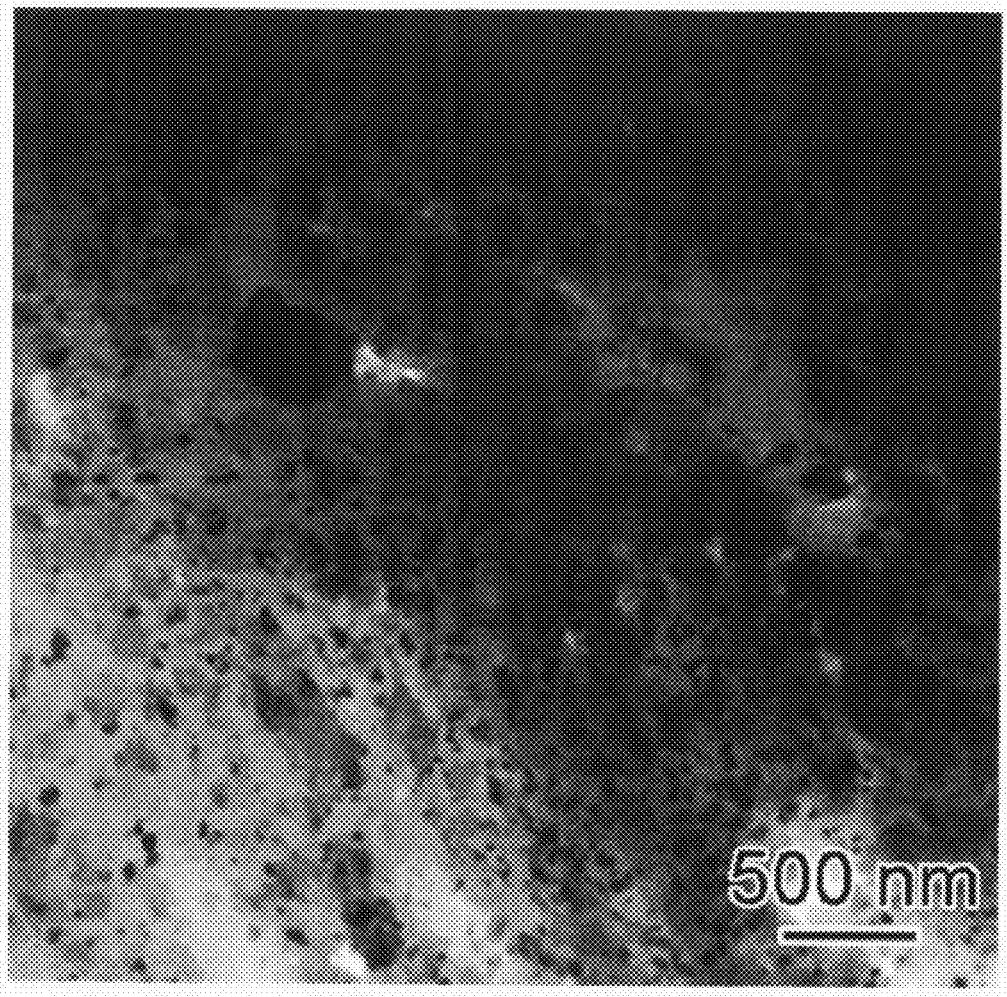
FIG. 22 is a BF-TEM image showing the microstructure of the sintered body in Example 4.
Figure 23:
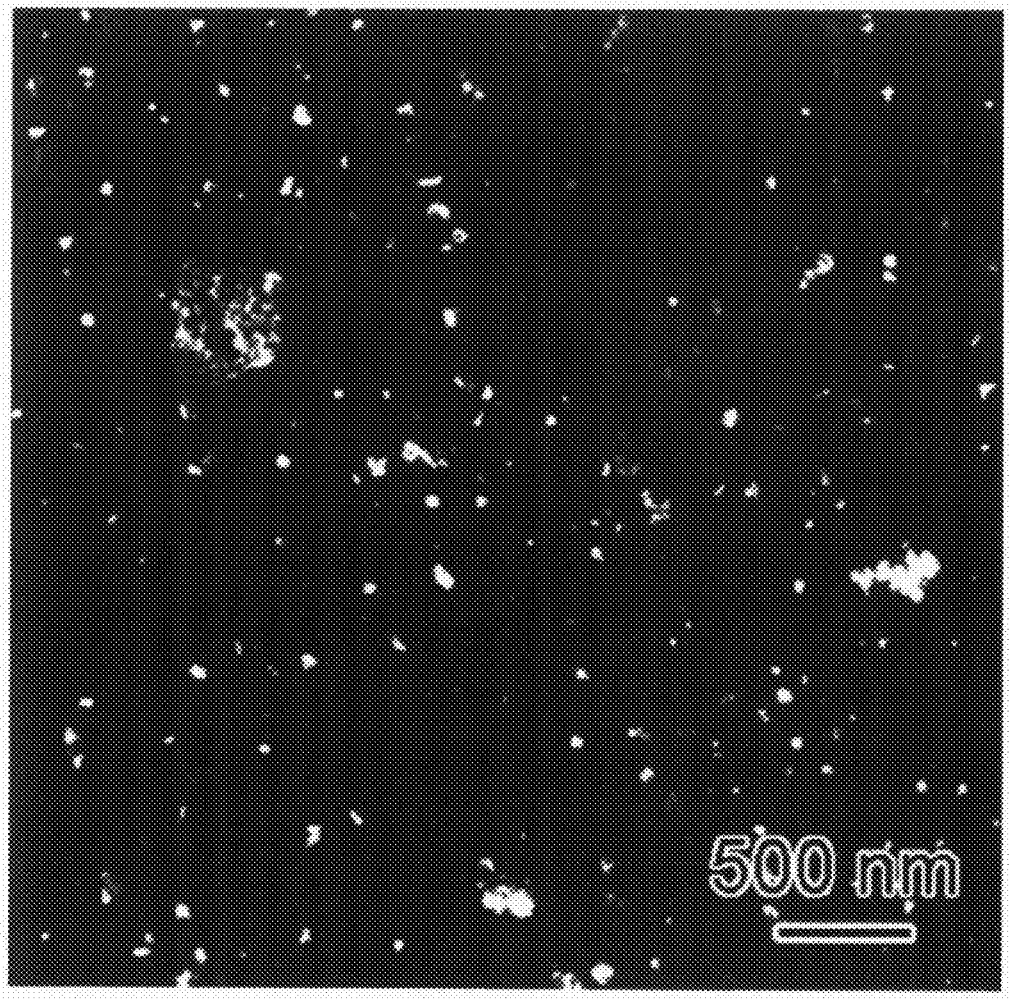
FIG. 23 is a DF-TEM image showing the microstructure of the sintered body in Example 4.
Figure 24:
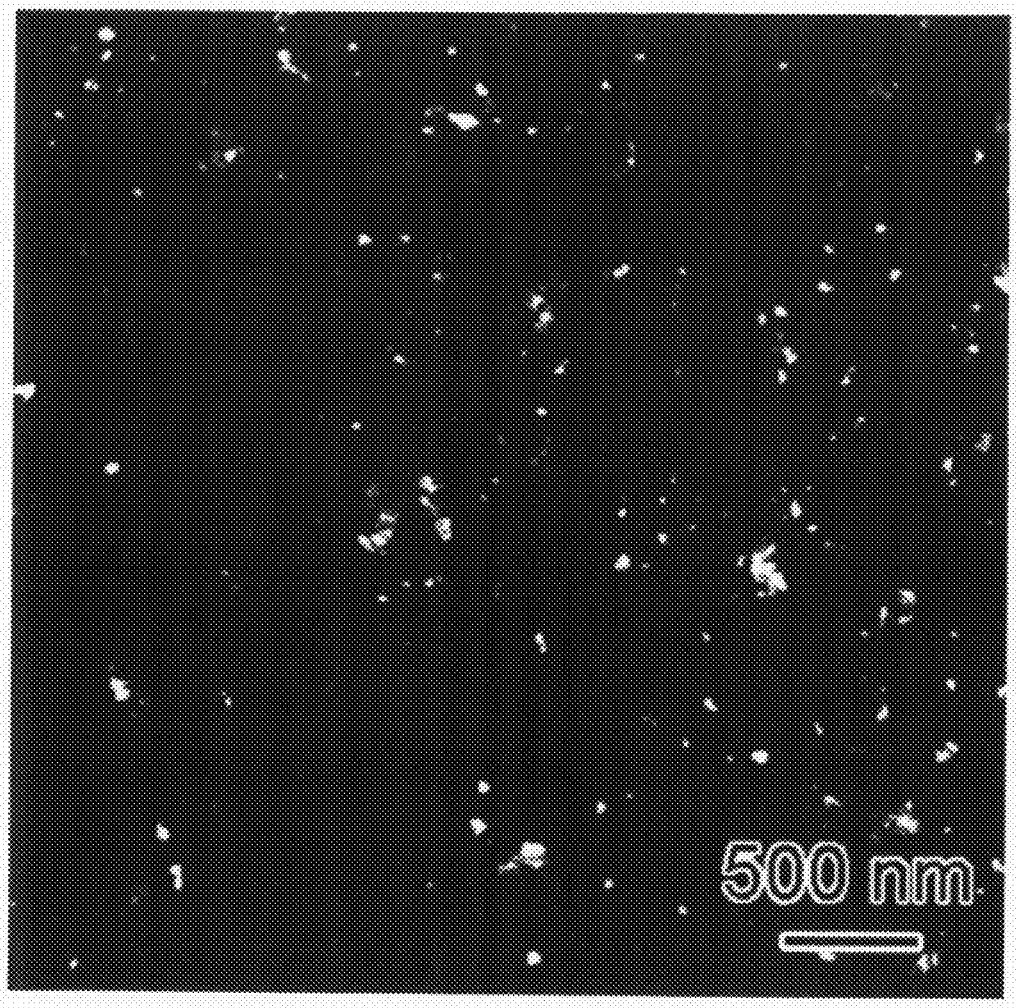
FIG. 24 is a DF-TEM image showing the microstructure of the sintered body in Example 4.

As in FIG. 22, the region shown by the gray contrast in FIG. 21 comprises a nanocrystalline phase. From FIGS. 23 and 24, it is known that the region comprises a composite phase structure of an α-Al phase having a crystal grain size of around 76 nm as the mother phase and an $Al_6Fe$ phase of around 90 nm dispersed in the mother phase. The ratio by volume of the $Al_6Fe$ phase and the $Al_{13}Fe_4$ phase in the composite phase structure is around 23% in total.

Figure 25:
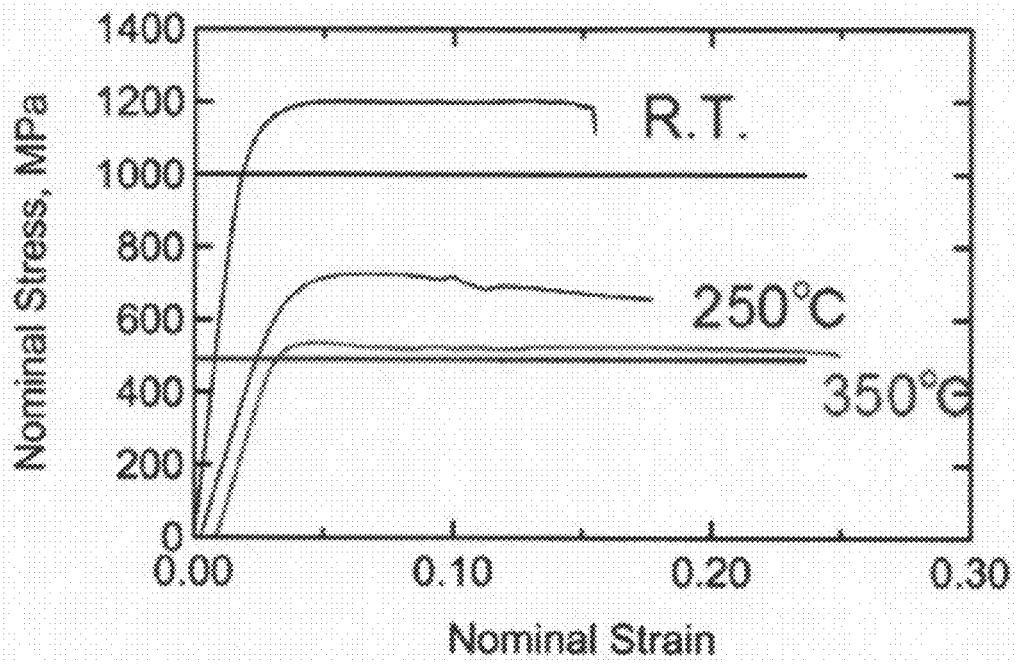
FIG. 25 is a compression stress-strain curve at high temperatures of the sintered body in Example 4.

The bulk material was tested for compression. As in FIG. 7, the material expressed an extremely high yield strength on a level of around 1.1 GPa, and exhibited a compression stress of around 0.15. In the compression test at 350° C., the material exhibited a yield stress of 488 MPa and a maximum stress of 510 MPa, as in FIG. 25.

INDUSTRIAL APPLICABILITY

The binary aluminum alloy powder sintered material of the invention is applicable to automobile engine parts that are required to be lightweight, such as pistons, rotors, vanes, etc. The method for producing the binary aluminum alloy powder sintered material of the invention is effective for producing the above-mentioned binary aluminum alloy powder sintered material.

The invention claimed is:

1. A binary aluminum alloy powder sintered material consisting of aluminum and iron, wherein α-aluminum phases and at least one of $Al_6Fe$ phases or $Al_{13}Fe_4$ phases as nanocrystalline phases are mixed in an aluminum matrix.

2. The binary aluminum alloy powder sintered material as claimed in claim 1, wherein a volume percentage of coarse grains of the α-aluminum phases is less than 5%.

3. A method of making the binary aluminum alloy powder sintered material as claimed in claim 1, comprising the steps of milling and mixing aluminum and iron in an inert gas by a mechanical alloying manner, having forcedly iron solve in aluminum, and sintering mixed powders in a vacuum or an inert gas.

4. A method of making the binary aluminum alloy powder sintered material as claimed in claim 2, comprising the steps of milling and mixing aluminum and iron in an inert gas by a mechanical alloying manner, having forcedly iron solve in aluminum, and sintering mixed powders in a vacuum or an inert gas.

* * * * *